US006823776B1

(12) United States Patent
Olds

(10) Patent No.: US 6,823,776 B1
(45) Date of Patent: Nov. 30, 2004

(54) MULTI-RAM BALE AND TIE BALER SYSTEM AND METHOD OF OPERATION

(75) Inventor: Emory L. Olds, Cordelle, GA (US)

(73) Assignee: IPS Balers, Inc., Baxley, GA (US)

( * ) Notice: Subject to any disclaimer, the term of this patent is extended or adjusted under 35 U.S.C. 154(b) by 0 days.

(21) Appl. No.: 10/321,878

(22) Filed: Dec. 17, 2002

(51) Int. Cl.[7] ..... B30B 7/04

(52) U.S. Cl. ..... 100/41; 100/42; 100/188 R; 100/232; 100/237

(58) Field of Search ..... 100/40, 41, 42, 100/76, 185, 186, 187, 188 R, 189, 218, 232, 237, 244

(56) References Cited

U.S. PATENT DOCUMENTS 4,658,719 A * 4/1987 Jackson et al. ..... 100/218
5,687,643 A * 11/1997 Felts et al. ..... 100/3
6,196,124 B1 * 3/2001 Schaeffer ..... 100/218
6,546,855 B1 * 4/2003 Van Der Beek et al. ..... 100/39

* cited by examiner

*Primary Examiner*—Allen Ostrager
*Assistant Examiner*—Shelley Self
(74) *Attorney, Agent, or Firm*—Hugh D. Jaeger

(57) ABSTRACT

A baler system for baling of waste or other products having high output and having a sequenced method of operation. A previously formed bale formed in accordance with the invention is urged in incremental stages from a secondary bale chamber through a bale exit chamber and strapper for tieing in continuous and simultaneous progression while units of compressed waste are compressed together in sequenced steps first within a primary bale chamber and subsequently within a secondary bale chamber in the creation of a newly formed bale in continuous and simultaneous progression.

26 Claims, 39 Drawing Sheets

MULTI-RAM BALE AND TIE BALER SYSTEM AND METHOD OF OPERATION

CROSS REFERENCES TO RELATED APPLICATIONS

None.

BACKGROUND OF THE INVENTION

1. Field of the Invention

The present invention pertains to a baler system for baling of waste or other products, and more particularly, relates to a multi-ram bale and tie baler system having high output and a sequenced method of operation.

2. Description of the Prior Art

Prior art baling systems, as well as present day baling systems, operate to compress waste material, such as cardboard, rags, light metals and the like. Great force and a lengthy time period are required to compact and compress such waste material into as small a bale or bundle as practicable. Operation of a baler system often processes waste material where the main focus of such baling is myopically concentrated towards the end of effecting a properly compacted bale of waste material by channeling and concentrating great crushing forces but devoting minimal effort towards the end of providing an efficiently operated baler system with respect to time. Such baling incorporates a series of crushing sequences which for the most part under utilize the components of the baler system where most steps are straightforward and simple but are accomplished inefficiently using simple daisy chain like logic such as first creating a bale, then strapping the bale, and finally ejecting the bale.

Clearly what is needed is a method of improving the efficiency of a baler system which improves the throughput, and a baler system constructed in accordance with the principles of the method such as is offered by the present invention, as now described.

SUMMARY OF THE INVENTION

The general purpose of the present invention is to provide a multi-ram bale and tie baler system and method of operation. The multi-ram bale and tie baler system includes closely associated multiple bale chambers including primary and secondary bale chambers located in adjacent proximity to each other. A hopper and hopper extension are located above a pre-compress chamber where a powered pre-compress lid provides for initial compressing of waste material when desired. A gatherer ram is actuated to urge pre-compressed, or non-compressed material if applicable, from the pre-compress chamber to the primary bale chamber, which is located adjacent to the pre-compress chamber for initial waste material compressing or compacting. Multiple cyclings of the gatherer ram for waste material compressing or compacting can be and are accomplished throughout the process. The primary bale chamber abuts the secondary bale chamber to which an ejector ram is aligned. The ejector ram is structured to be positioned across one end of the primary bale chamber to act as a positionable and sturdy end of the primary bale chamber. Preferably, pre-compressed waste, or even waste which is not pre-compressed, is further compressed or compacted in the primary bale chamber against the ejector ram for several different cycles and operations of the gatherer ram as required. Further and final compressing or compacting occurs later upon entry of the not yet completed bale into the secondary bale chamber.

The secondary bale chamber abuts the primary bale chamber. The ejector ram can be retracted from a position forming the end of the primary bale chamber to allow access and movement of a partially completed bale to the secondary bale chamber from the primary bale chamber. Such access allows waste material partially baled in early baling steps and additional recently added pre-compressed material in the primary bale chamber to be urged by the gatherer ram into the secondary bale chamber for further and final compressing or compacting.

At the same time initial compressing or compacting occurs in the pre-compress chamber and the primary bale chamber and final compressing or compacting occurs in the secondary bale chamber, simultaneous handling and processing of a previously formed and completed bale is effected by continual incremental urging of the previously formed bale from the secondary bale chamber to a bale exit chamber. Such urging positions the completed compressed or compacted bale along the bale strap chamber to align various portions of the bale with a strapping machine to receive a plurality of straps applied around and about the bale, thus tieing the bale. Thus, continual simultaneous compressing and strapping occur to provide for maximum efficiency and minimum throughput time.

According to one or more embodiments of the present invention, there is provided a multi-ram bale and tie baler system including a framework and a plurality of components mounted to or within the framework including a hydraulically powered gatherer ram, a pre-compress chamber, a powered rotatable pre-compress lid aligned for positioning above the pre-compress chamber, a hopper aligned to and over the pre-compress chamber, a hopper extension aligned to the top of the hopper, a primary bale chamber aligned to and adjacent to one side of the pre-compress chamber, a secondary bale chamber aligned to the primary bale chamber being capable of communication with the primary bale chamber, an ejector ram which is aligned to and positioned within or which can be distant from the secondary chamber and which can be positioned and aligned across one end of the primary chamber to assist in formation of a primary bale chamber or positioned from alignment with one end of the primary chamber to allow access from the primary bale chamber, a bale exit chamber adjacent to and connected to the secondary bale chamber, a bale door, a strapper for tieing a bale with strapping located at one end of the bale exit chamber, a strapper power unit, and a hydraulic power unit.

One significant aspect and feature of the present invention is a multi-ram bale and tie baler system where a waste bale is formed in conjunction with a pre-compress chamber, a primary bale chamber and a secondary bale chamber, and, simultaneously, where a previously compacted or compressed and formed bale is tied with strapping and urged incrementally from a bale exit chamber of the multi-ram bale and tie baler system.

Yet another significant aspect and feature of the present invention is the use of a pre-compress lid and a pre-compress chamber.

A further significant aspect and feature of the present invention is the use of an ejector ram to form an end of a primary bale chamber against which waste can be compressed or compacted.

A further significant aspect and feature of the present invention is a positionable ejector ram which can be positioned to allow access and entry of a partially compressed or compacted bale from a primary bale chamber to a secondary bale chamber where final waste compressing or compacting can be accomplished.

A still further significant aspect and feature of the present invention is where a final or last unit of pre-compressed waste is added to previously formed units of compressed waste in a secondary bale chamber and compressed therein for formation of a waste bale.

A still further significant aspect and feature of the present invention is the bale compressing or compacting which occurs in more than one bale chamber.

Still another significant aspect and feature of the present invention is sequencing of operation of the components of the multi-ram bale and tie baler system.

Having thus set forth distinguishing traits of the present invention, it is one object of the present invention to provide a multi-ram bale and tie baler system and method of operation.

Other objects of the present invention are now set forth.

Other aspects of the baler system include a sequenced operation for the baling of materials by the multi-ram bale and tie baler system including the steps where:

The ejector ram advances to contact and incrementally urge a previously formed bale along the bale exit chamber to a first position beneath a strapper. The strapper applies a first strap around and about the first portion of a previously formed bale at the first position. The gatherer ram retracts. The pre-compress lid opens allowing waste to enter the pre-compress chamber.

Simultaneously, the pre-compress lid closes sealing the bottom region of the hopper extension and sealing the upper region of the pre-compress chamber to form waste into pre-compressed waste, and the ejector ram advances incrementally to urge a previously formed bale along the bale exit chamber to a second position beneath the strapper. The strapper applies a second strap around and about a second portion of a previously formed bale at a second position.

The gatherer ram advances to urge pre-compressed waste from the pre-compress chamber into the primary bale chamber and against the ejector ram, being part of the primary bale chamber, to form a first unit of compressed waste, thus partially forming a newly formed bale. Waste loads into the hopper extension such as by an external conveyor.

The gatherer ram retracts. The pre-compress lid opens to allow waste in the hopper extension to be deposited in the pre-compress chamber. During gatherer ram retraction and pre-compress lid opening, the ejector ram is advanced incrementally to urge a previously formed bale along the bale exit chamber to a third position beneath the strapper. The strapper applies a third strap around and about a third portion of a previously formed bale at a third position.

Simultaneously, the pre-compress lid closes sealing the bottom region of the hopper extension and sealing the upper region of the pre-compress chamber to form waste into pre-compressed waste, and the ejector ram advances incrementally to urge a previously formed bale along the bale exit chamber to a fourth position beneath the strapper. The strapper applies a fourth strap around and about a fourth portion of a previously formed bale at a fourth position.

The gatherer ram advances to urge pre-compressed waste from the pre-compress chamber into the primary bale chamber against the first unit of compressed waste to form a second unit of compressed waste and to combine with the first unit of compressed waste, thus partially and additionally contributing to the formation of the newly formed bale. Waste loads into the hopper extension such as by an external conveyor.

The gatherer ram retracts. The pre-compress lid opens to allow waste in the hopper extension to be deposited in the pre-compress chamber. During the gatherer ram retraction and pre-compress lid opening, the ejector ram advances incrementally to urge a previously formed bale along the bale exit chamber to a fifth position beneath the strapper. The strapper applies a fifth strap around and about a fifth portion of a previously formed bale at the fifth position.

Simultaneously, the pre-compress lid closes sealing the bottom region of the hopper extension and sealing the upper region of the pre-compress chamber to form waste into pre-compressed waste, and the ejector ram advances incrementally to urge a fully strapped previously formed bale along and beyond the bale exit chamber.

The ejector ram retracts, thus providing communication between the primary bale chamber and the secondary bale chamber. The ejector ram retracts a sufficient distance to allow the ejector ram front plate to form one side of the secondary bale chamber, and the bale door is closed to form another side of the secondary bale chamber. The gatherer ram advances to urge pre-compressed waste from the pre-compress chamber through the primary bale chamber against the second unit of compressed waste.

The gatherer ram urges the first unit of compressed waste, the second unit of compressed waste and the pre-compressed waste into the secondary bale chamber to form a last unit of compressed waste from the pre-compressed waste to combine the pre-compressed waste directly with the second unit of compressed waste as a last unit of compressed waste and indirectly with the first unit of compressed waste, thus fully and additionally contributing to the formation of a completed newly formed bale. The bale door opens. Simultaneously, during the gatherer ram advancement and bale door opening, the pre-compress lid closes sealing the bottom region of the hopper extension and sealing the upper region of the pre-compress chamber. Waste is then loaded into the hopper extension. Repetition of the previously described steps is carried out to form yet another new bale and to eject the bale just completed from the secondary bale chamber.

Sequential operational steps may be reduced or increased depending on the density and the composition of the waste material.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 4 is a side view of the multi-ram bale and tie baler system;

FIG. 5 is a top view of the multi-ram bale and tie baler system;

FIG. 6 is a mid-section view through the pre-compress chamber, the hopper, and the hopper extension of the multi-ram bale and tie baler system;

FIG. 7 is an end view of the multi-ram bale and tie baler system;

FIG. 8 is a side view of the multi-ram bale and tie baler system;

FIG. 9 is a top view of the multi-ram bale and tie baler system;

FIG. 10 is a mid-section view through the pre-compress chamber, the hopper, and the hopper extension of the multi-ram bale and tie baler system;

FIG. 11 is an end view of the multi-ram bale and tie baler system;

FIG. 12 is a side view of the multi-ram bale and tie baler system;

FIG. 13 is a top view of the multi-ram bale and tie baler system;

FIG. 14 is a mid-section view through the pre-compress chamber, the hopper, and the hopper extension of the multi-ram bale and tie baler system;

FIG. 15 is an end view of the multi-ram bale and tie baler system;

FIG. 16 is a side view of the multi-ram bale and tie baler system;

FIG. 17 is a top view of the high output baler system;

FIG. 18 is a mid-section view through the pre-compress chamber, the hopper, and the hopper extension of the high output baler system;

FIG. 19 is an end view of the high output baler system;

FIG. 20 is a side view of the high output baler system;

FIG. 21 is a top view of the multi-ram bale and tie baler system;

FIG. 22 is a mid-section view through the pre-compress chamber, the hopper, and the hopper extension of the multi-ram bale and tie baler system;

FIG. 23 is an end view of the multi-ram bale and tie baler system;

FIG. 24 is a side view of the multi-ram bale and tie baler system;

FIG. 25 is a top view of the multi-ram bale and tie baler system;

FIG. 26 is a mid-section view through the pre-compress chamber, the hopper, and the hopper extension of the multi-ram bale and tie baler system;

FIG. 27 is an end view of the multi-ram bale and tie baler system;

FIG. 28 is a side view of the multi-ram bale and tie baler system;

FIG. 29 is a top view of the multi-ram bale and tie baler system;

FIG. 30 is a mid-section view through the pre-compress chamber, the hopper, and the hopper extension of the multi-ram bale and tie baler system;

FIG. 31 is an end view of the multi-ram bale and tie baler system;

FIG. 32 is a side view of the multi-ram bale and tie baler system;

FIG. 33 is a top view of the multi-ram bale and tie baler system;

FIG. 34 is a mid-section view through the pre-compress chamber, the hopper, and the hopper extension of the multi-ram bale and tie baler system;

FIG. 35 is an end view of the multi-ram bale and tie baler system;

FIG. 36 is a side view of the multi-ram bale and tie baler system;

FIG. 37 is a top view of the multi-ram bale and tie baler system;

FIG. 38 is a mid-section view through the pre-compress chamber, the hopper, and the hopper extension of the multi-ram bale and tie baler system; and, FIG. 39 is an end view of the multi-ram bale and tie baler system.

DETAILED DESCRIPTION OF THE PREFERRED EMBODIMENT

Figure 1:
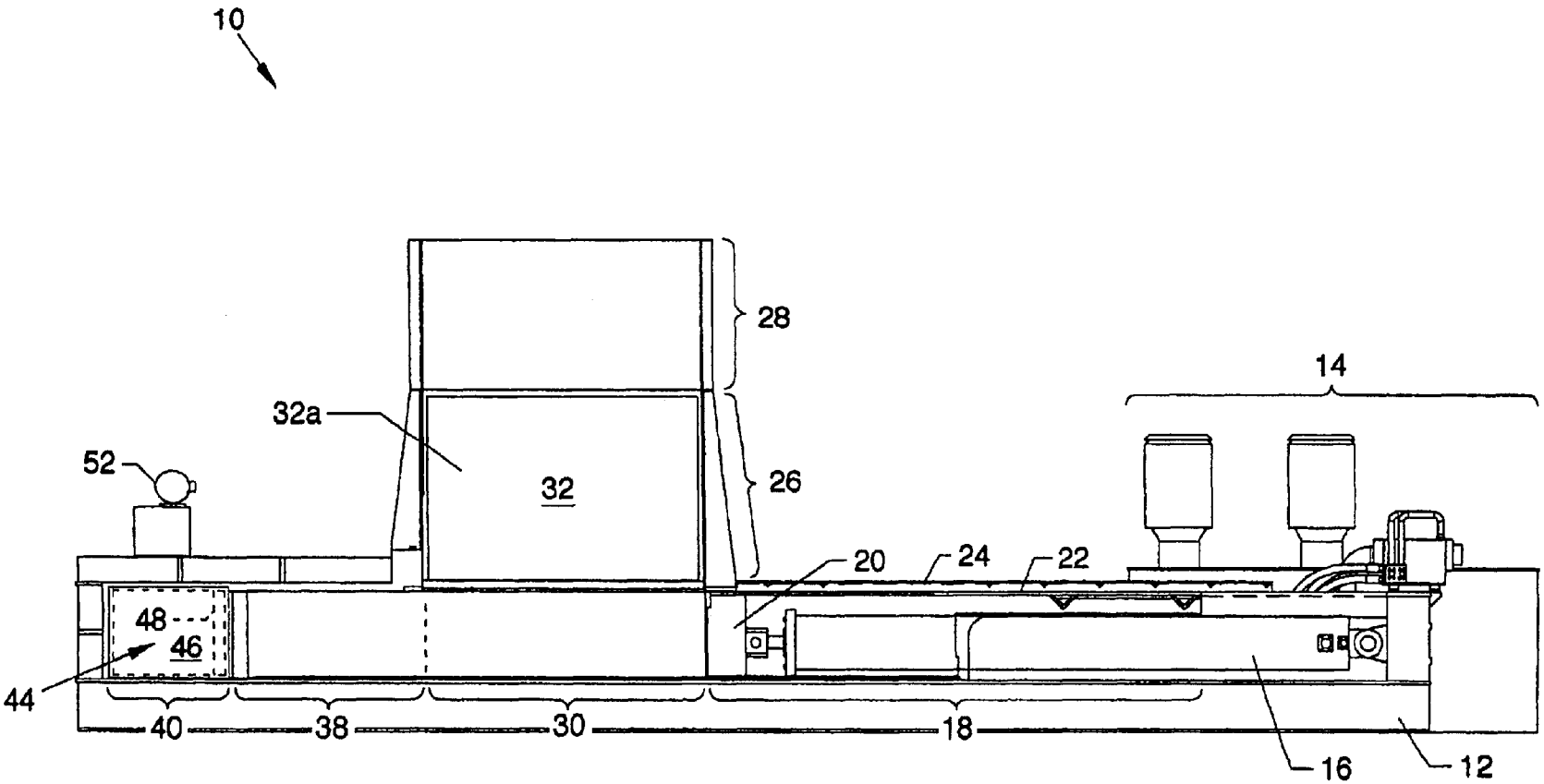
FIG. 1 is a side view in partial cutaway of a multi-ram bale and tie baler system, the present invention.
Figure 2:
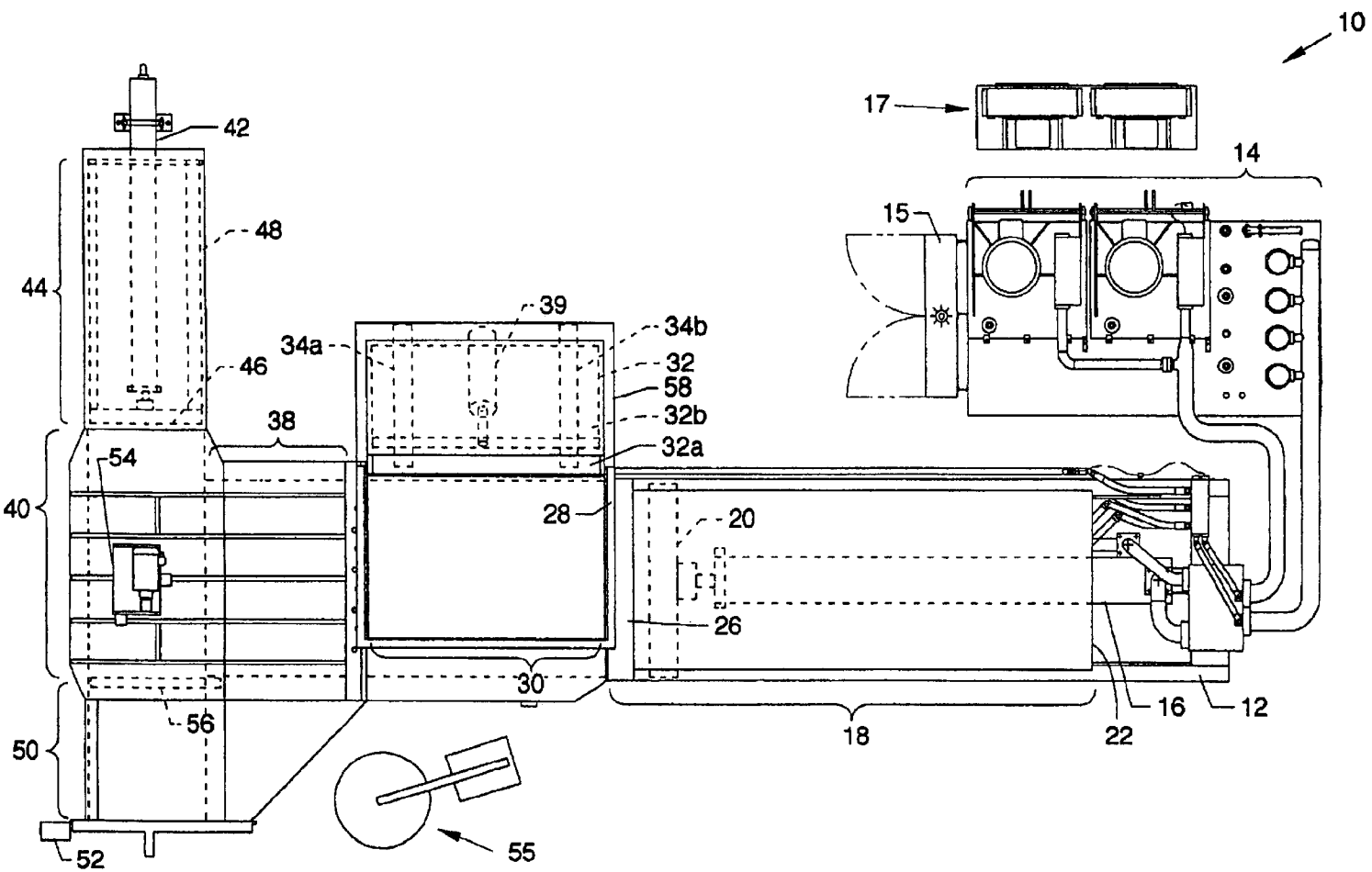
FIG. 2 is a top view of the multi-ram bale and tie baler system.
Figure 3:
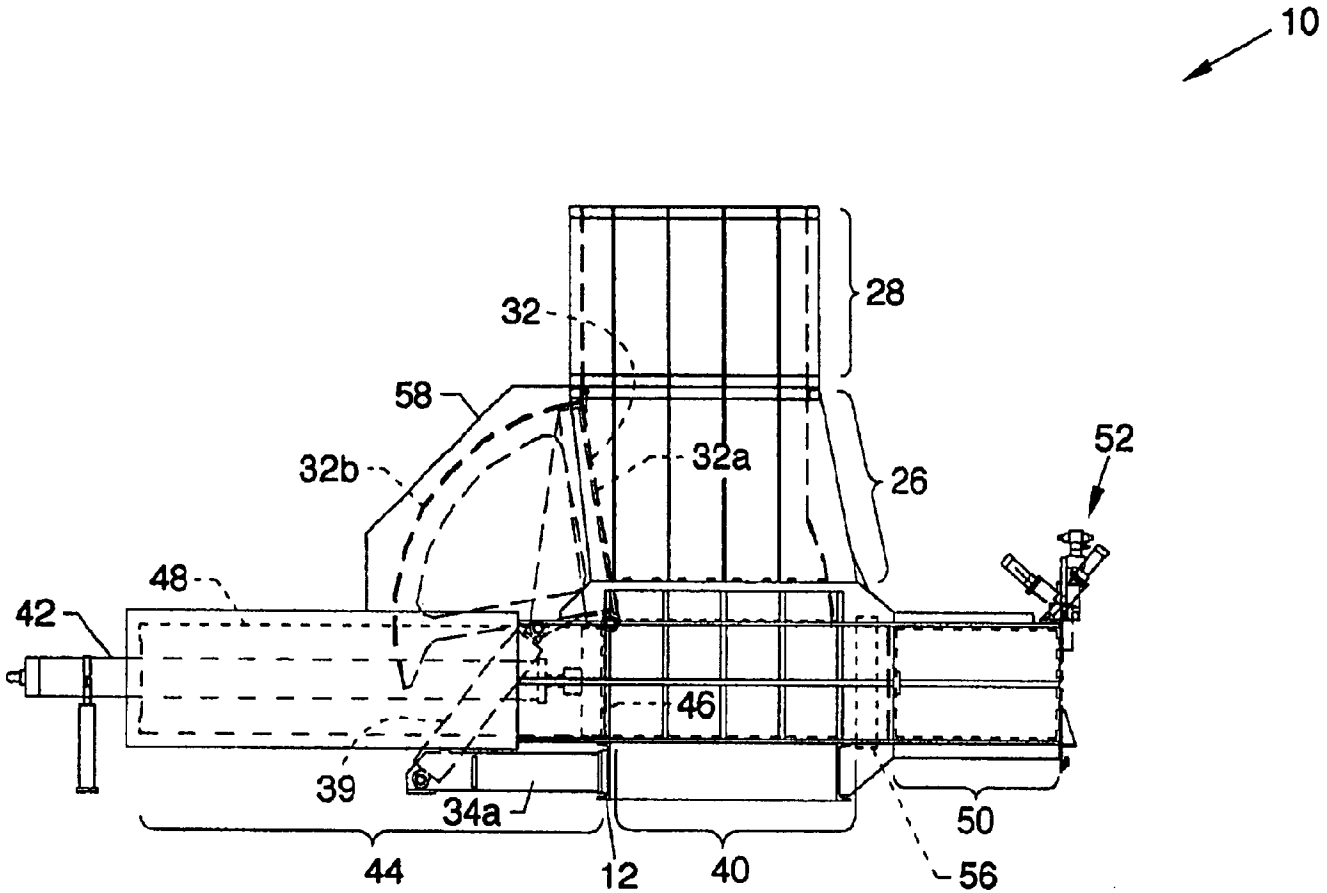
FIG. 3 is an end view of the multi-ram bale and tie baler system.

FIG. 1 is a side view in partial cutaway of the multi-ram bale and tie baler system 10. FIG. 2 is a top view of the multi-ram bale and tie baler system 10. FIG. 3 is an end view of the multi-ram bale and tie baler system 10. With reference to FIGS. 1, 2 and 3, the invention is now described. The multi-ram bale and tie baler system 10 includes major components most of which mount on or about a framework 12 or adjacent to or on other structure shown in FIGS. 1, 2 and 3, including a hydraulic power unit 14, a control panel 15, hydraulic power unit cooling fans 17, a gatherer ram hydraulic actuator cylinder 16 and gatherer ram 18 including at least a gatherer ram front plate 20 and a gatherer ram top plate 22 shown generally in a gatherer ram component housing 24, a hopper 26 and a hopper extension 28 secured over and above a pre-compress chamber 30, a pre-compress lid 32, shown in the open position, having a planar lid plate 32*a* and an arced lid plate 32*b* pivotally secured to an upper region of the framework 12 and located for pivotal operation into the pre-compress chamber 30, a pre-compress lid hydraulic actuator cylinder support structure 34*a* and 34*b* secured to and extending outwardly from the framework 12, a pre-compress lid hydraulic actuator cylinder 39 secured between the outboard end of the pre-compress lid hydraulic actuator cylinder support structure 34*a*–34*b* and the pre-compress lid 32, a primary bale chamber 38 adjacent to the pre-compress chamber 30 being open between the pre-compress chamber 30 and a secondary bale chamber 40, a secondary bale chamber 40 communicating at times with the adjacent primary bale chamber 38, an ejector ram hydraulic actuator cylinder 42, an ejector ram 44 having at least an ejector ram front plate 46 and a vertically aligned ejector ram side plate 48, a bal exit chamber 50, a bale strapper 52 at one end of the bale exit chamber 50, a strapper power unit 54, a bale strap supply 55, a bale door 56 at one end of the bale exit chamber 50, and a protective enclosure 58 which guards personnel from movement of the pre-compress lid 32.

The multi-ram bale and tie baler system 10 includes continuous and multi-functional operation to efficiently and quickly bale scrap material. To achieve an efficient baling operation, a bale is built and a bale is progressively ejected at the same time. As one bale is incrementally formed in steps, another bale is in the process of being tied or strapped and incrementally ejected in steps. Such an operation simultaneously combines baling, tieing and ejecting processes whereas previous art balers incorporate a first general step of baling followed by a second general step of tieing a bale and a third step of ejecting of the same bale. The gatherer ram 18 advances under great force the waste material from the pre-compress chamber 30 into the primary bale chamber 38.

In the instant invention, the ejector ram 44 assumes an important role in the efficient function of the system. The ejector ram 44, including the ejector ram side plate 48 is continually advanced and positioned to cause the ejector ram side plate 48 to act as an advancing substantially constructed end of the primary bale chamber 38. Several compacting cycles occur where the gatherer ram 18 advances under great force against the waste material in the pre-compress chamber 30 moving it into the primary bale chamber 38 where waste material is compacted. Subsequently, the ejector ram 44, including the ejector ram side plate 48, is retracted and additional waste material is loaded and advanced by the gatherer ram 18 and advanced toward the partially formed bale to urge the partially formed bale residing in the primary bale chamber 38 and the recently added waste material beyond the location formerly occupied by the now removed ejector ram side plate 48 into the secondary bale chamber 40 for further and final compacting. At the same time, when compacting in the primary bale chamber 38 occurs and additional loading and compacting of the waste material occurs during the composing of the partially formed bale by the gatherer ram 18, as just described, a previously compacted previously formed bale in the secondary bale chamber 40 is incrementally or continuously advanced by the action of the ejector ram 44 into and through the bale exit chamber 50 where the strapper 52 applies bale strapping to the bale in different stages to tie the bale as the bale is incrementally urged therethrough.

Figure 4:
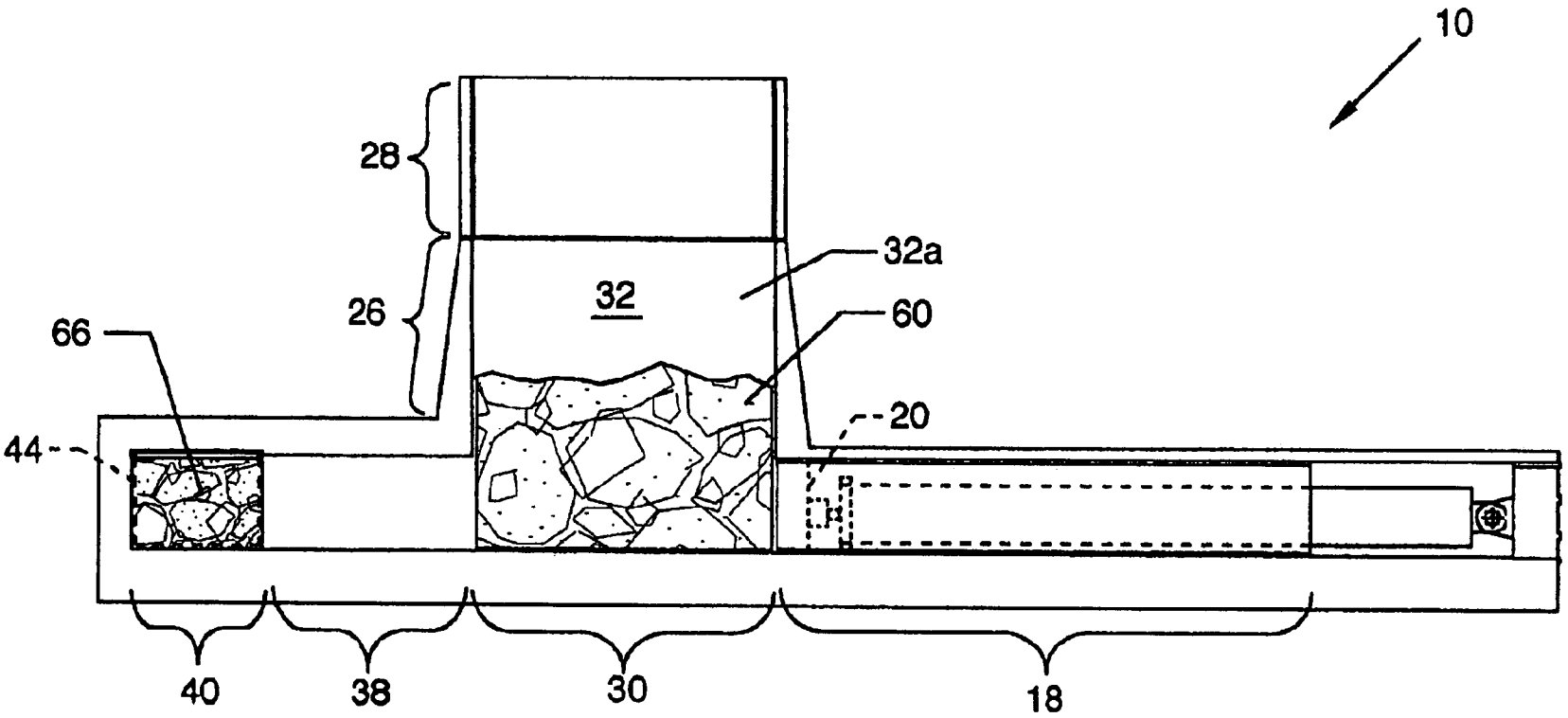
FIGS. 4–39 are simplified figures in partial cutaway view illustrating the mode of operation of the multi-ram bale and tie baler system where.
Figure 5:
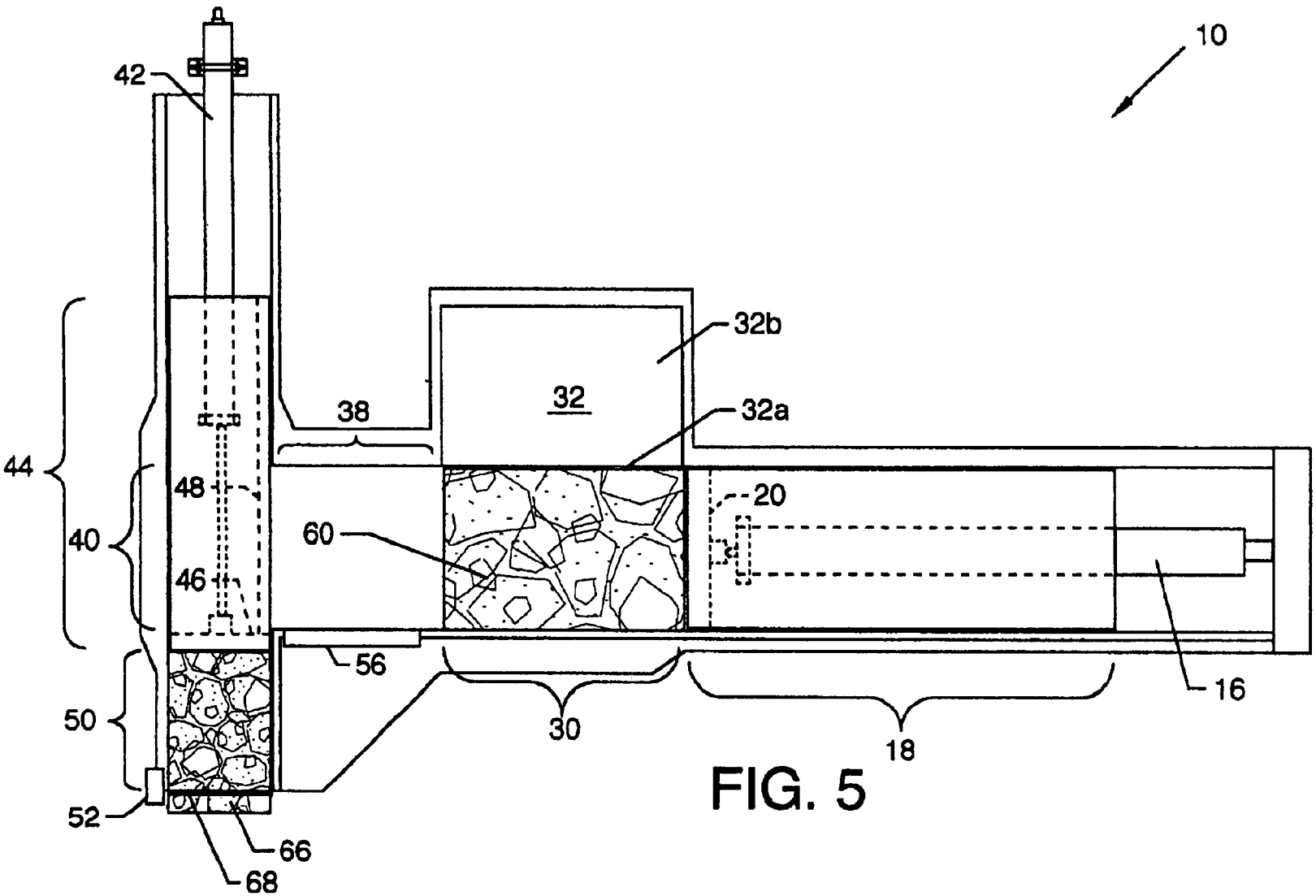
Figure 6:
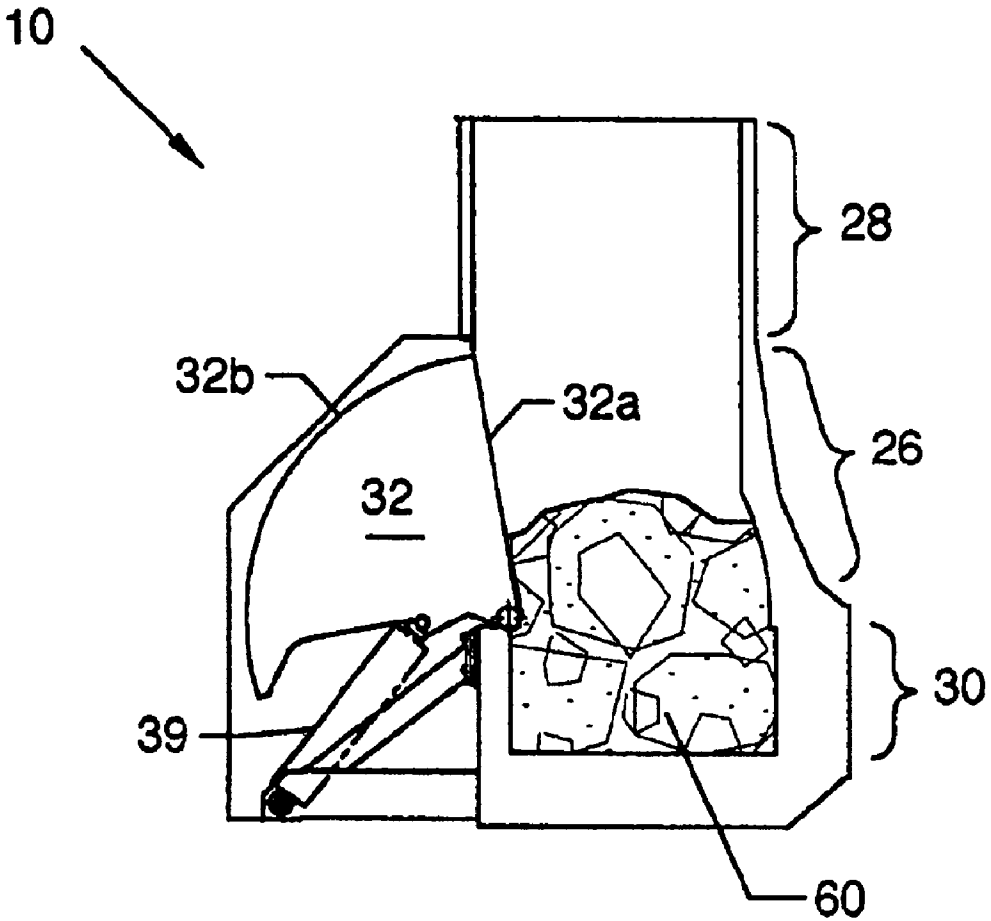
Figure 7:
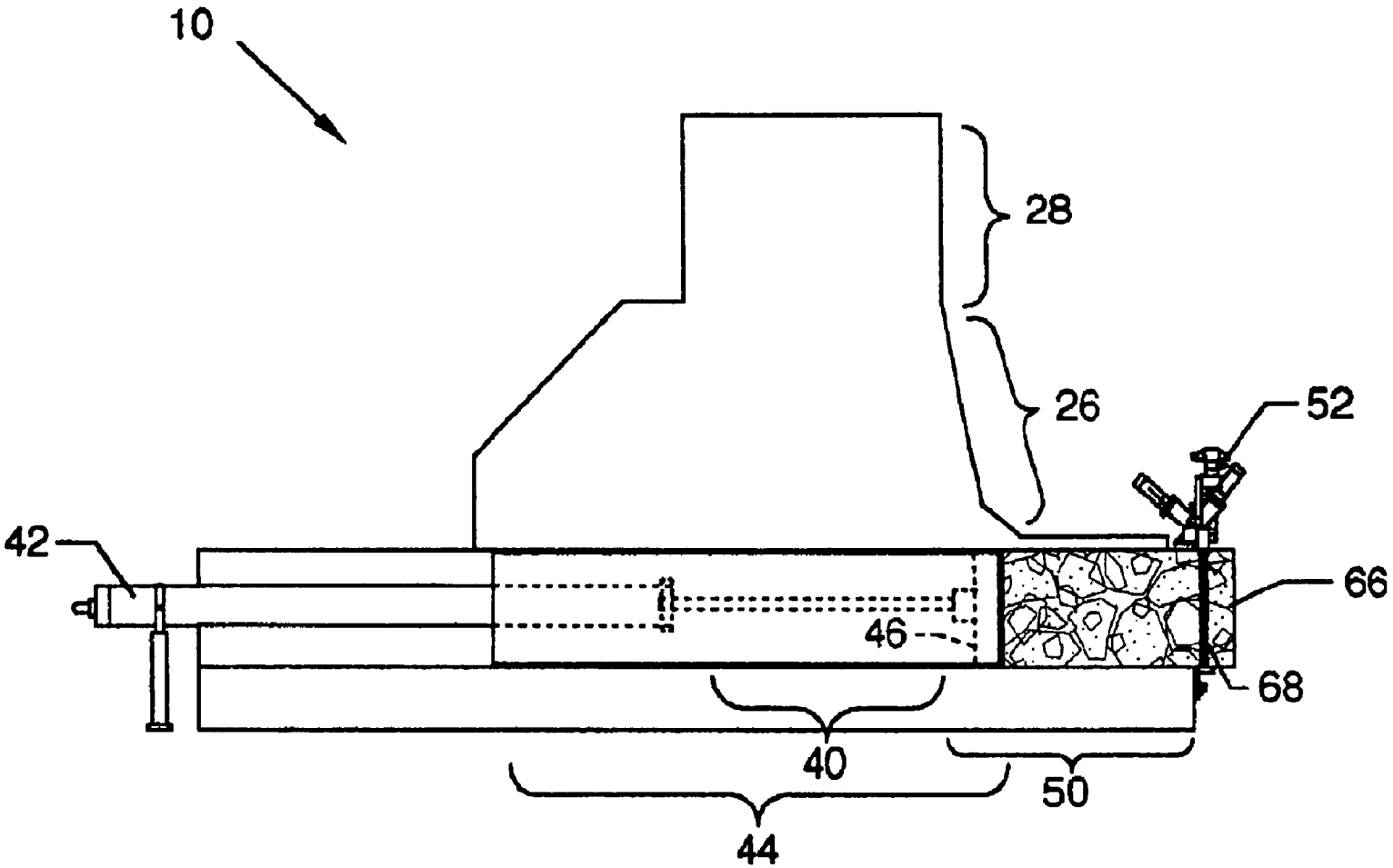
Figure 8:
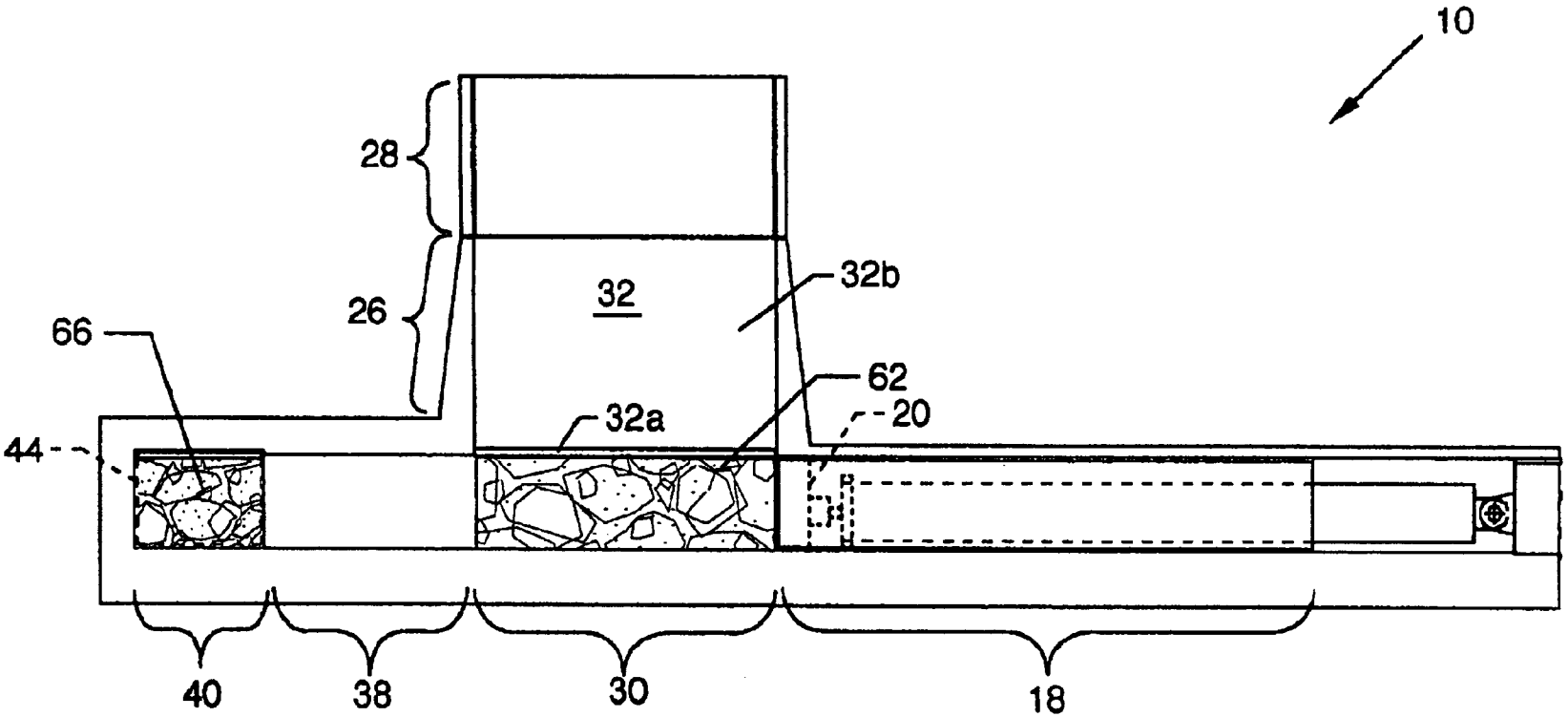
Figure 9:
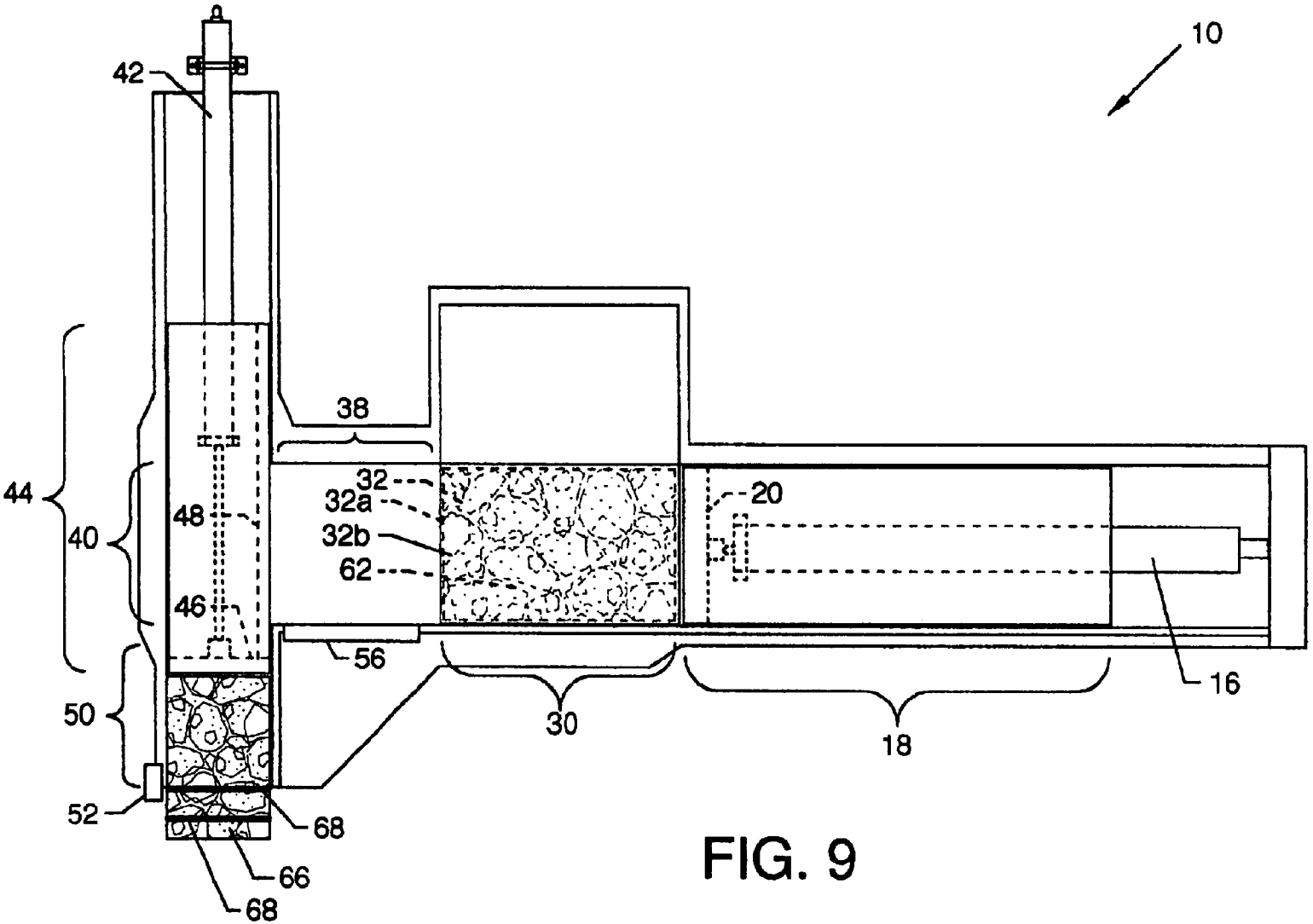
Figure 10:
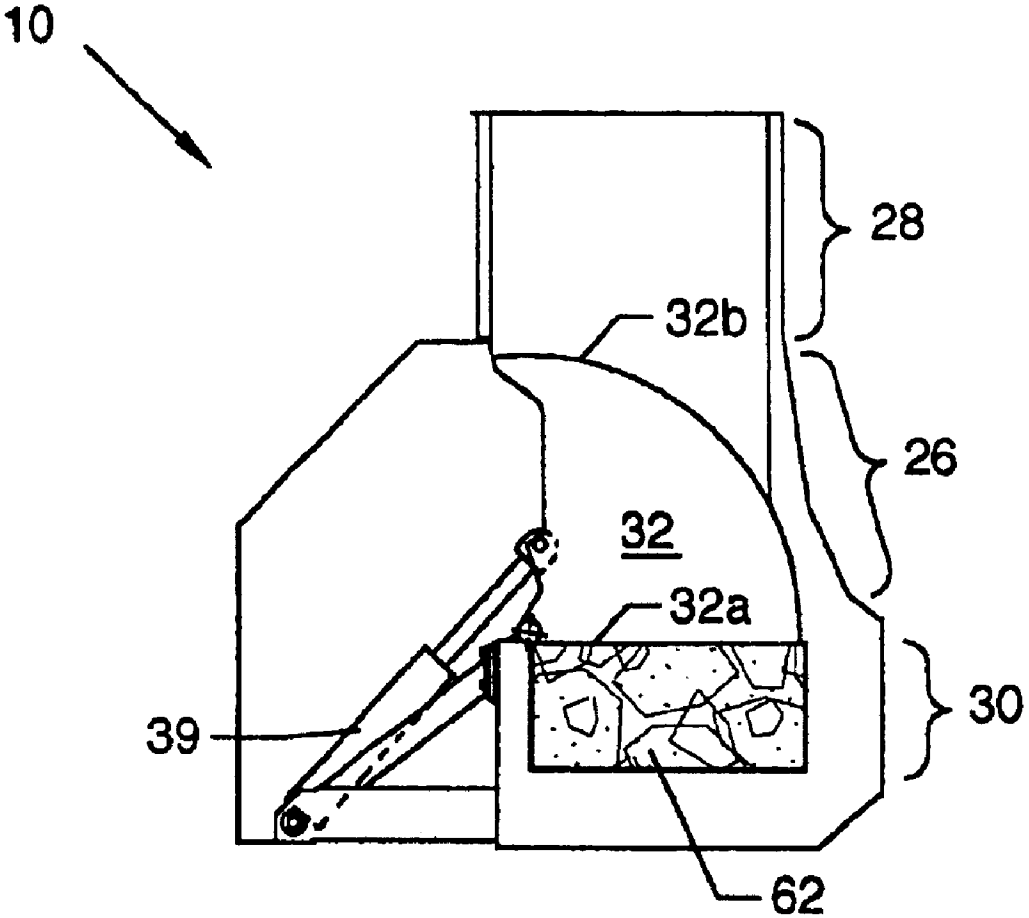
Figure 11:
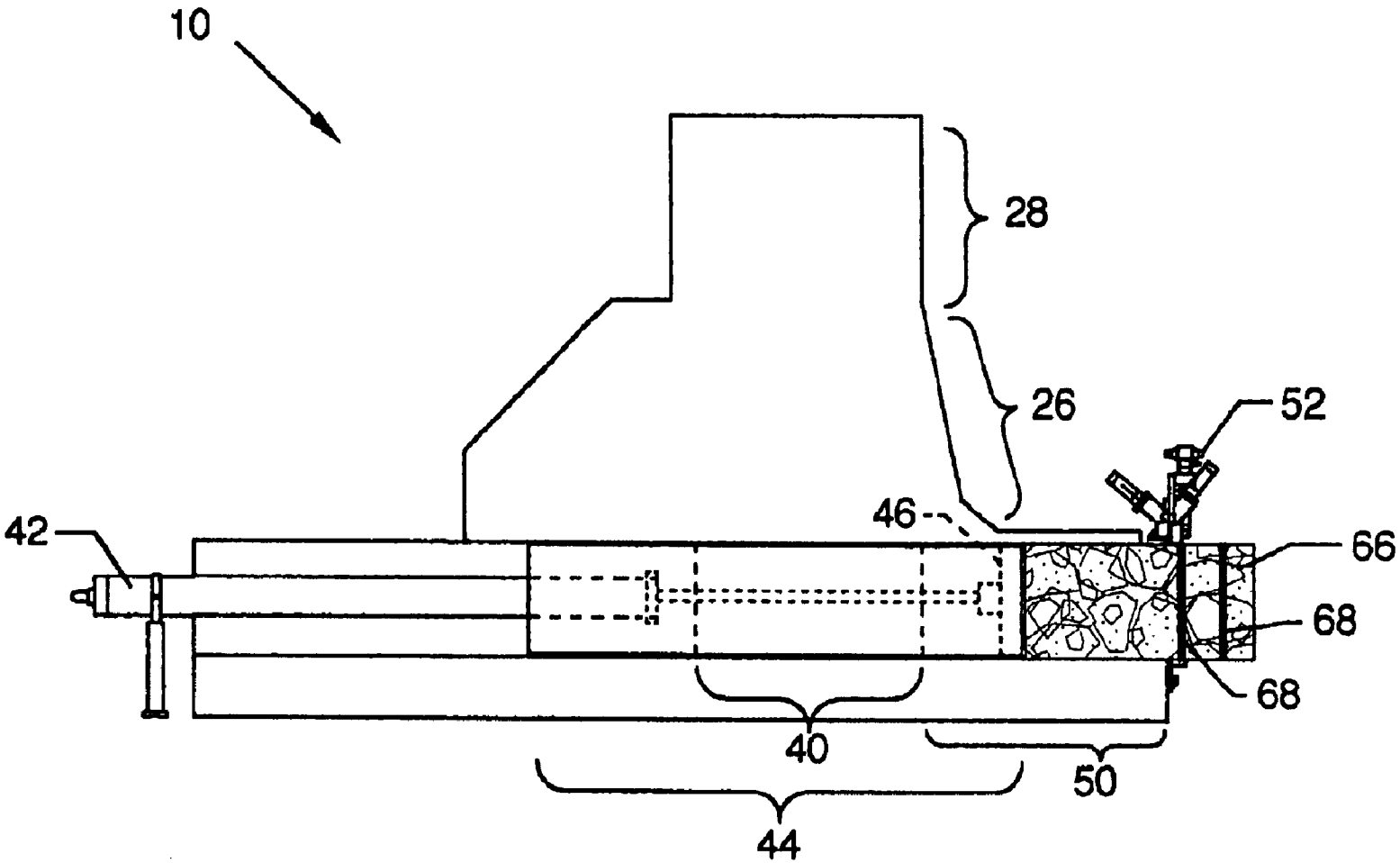
Figure 12:
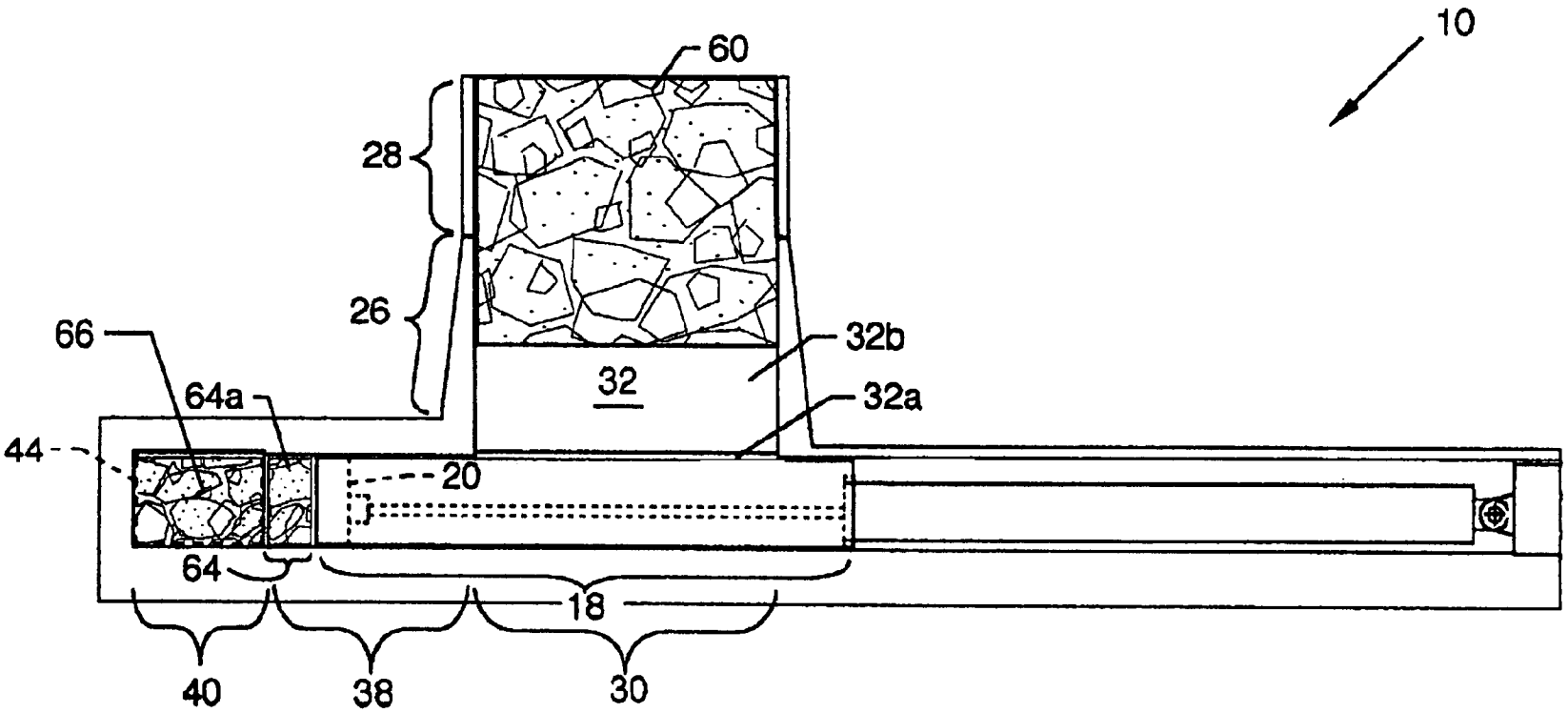
Figure 13:
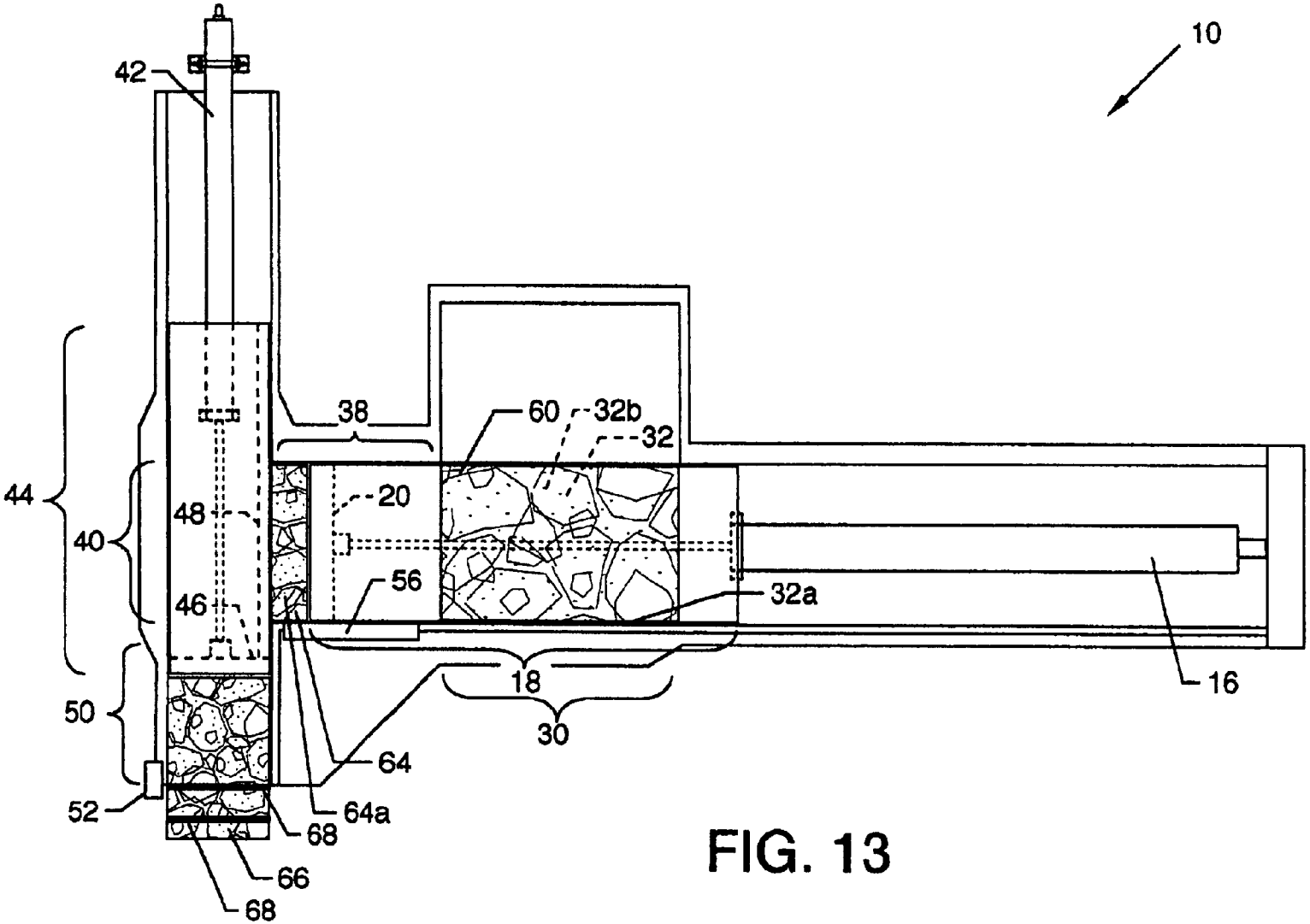
Figure 14:
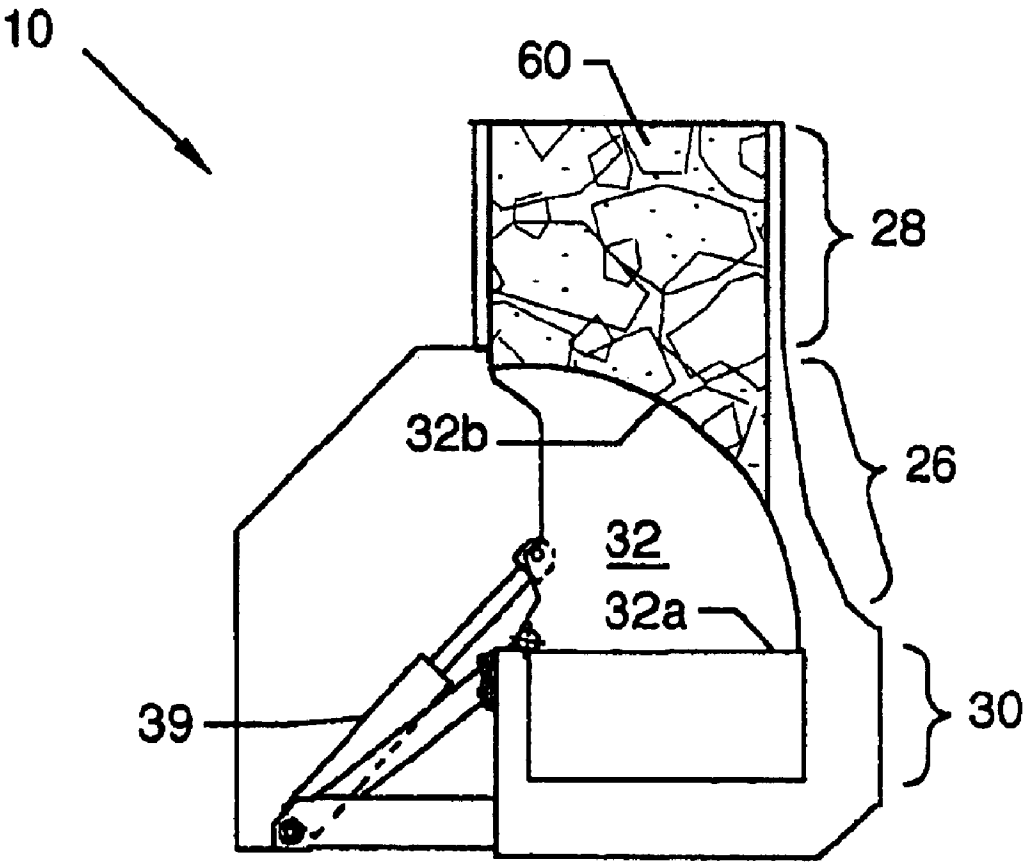
Figure 15:
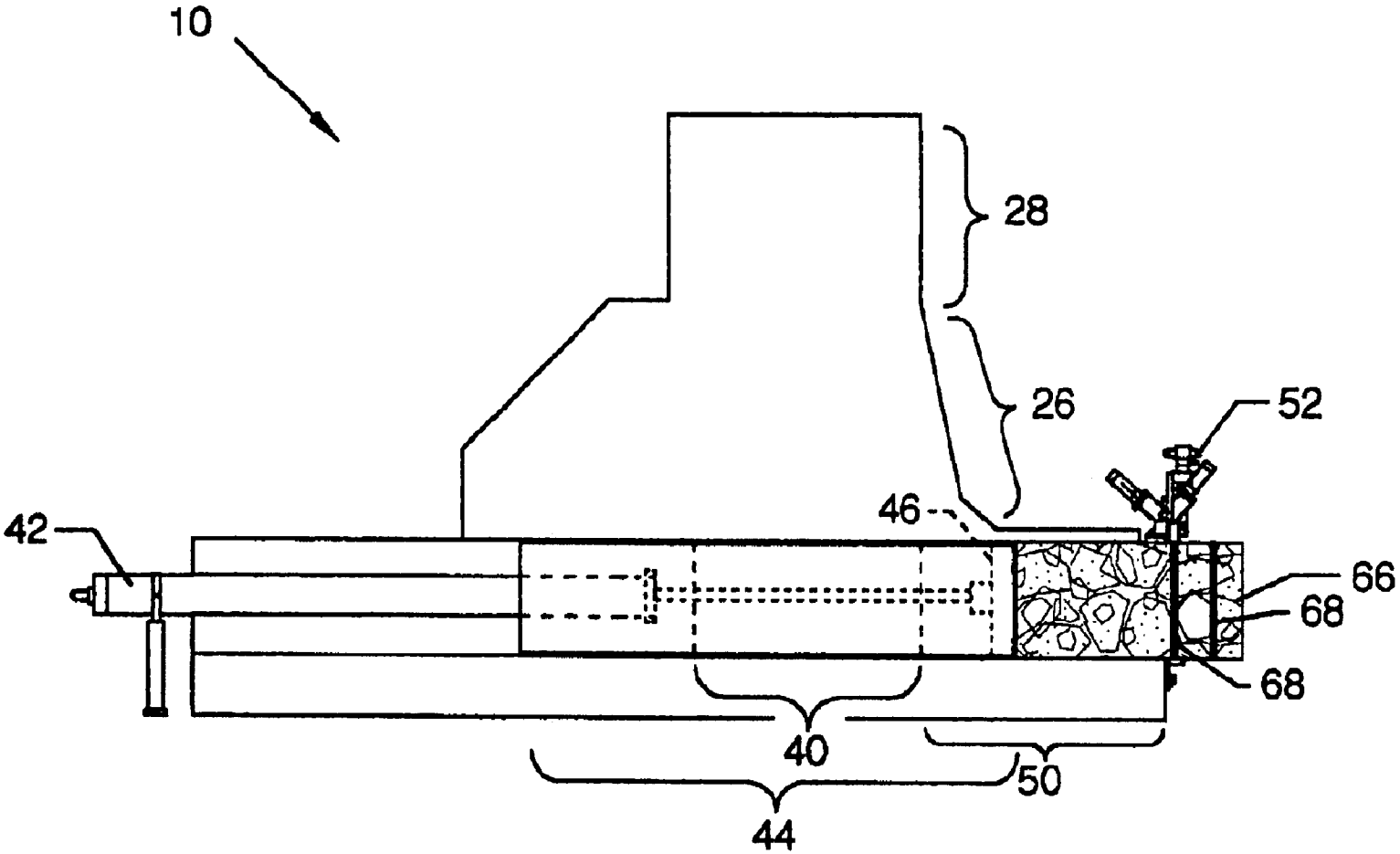
Figure 16:
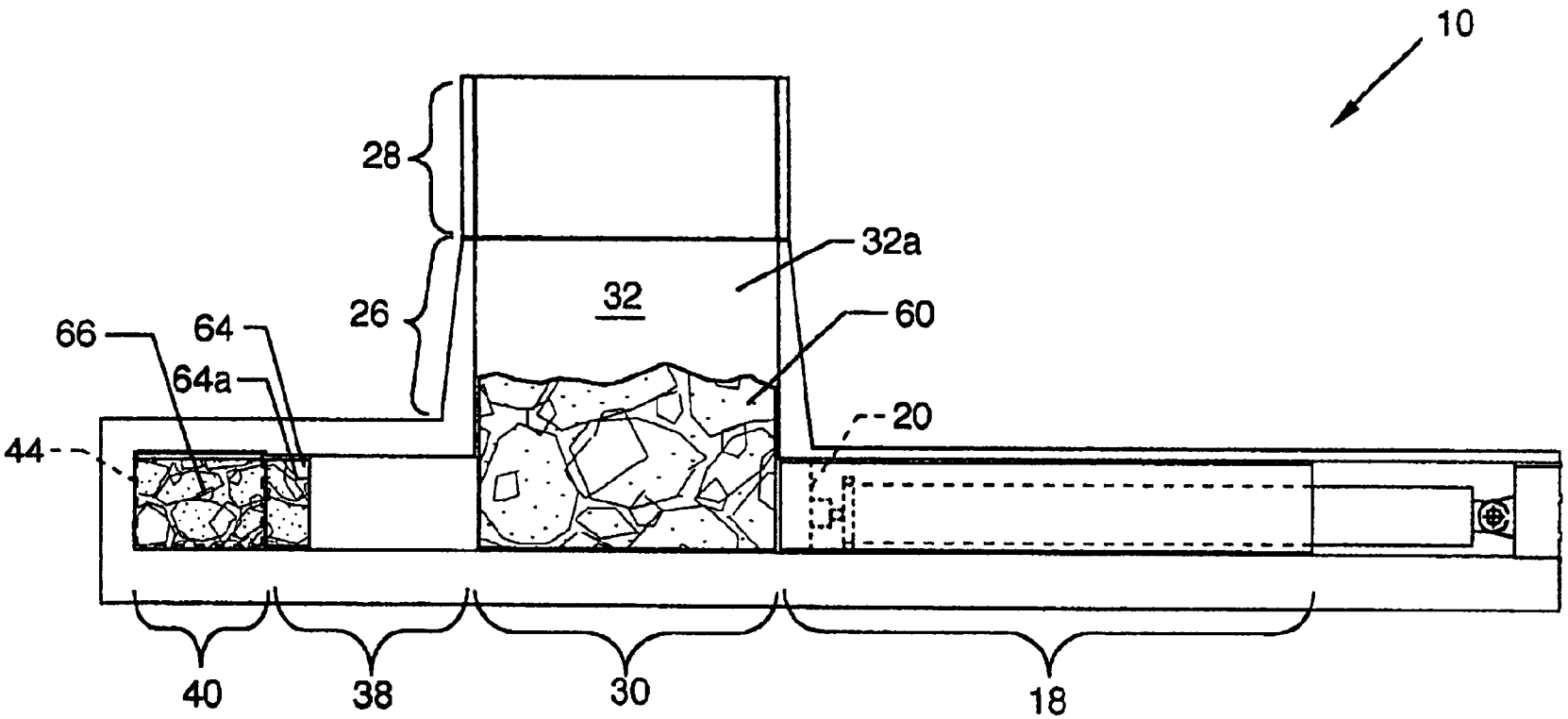
Figure 17:
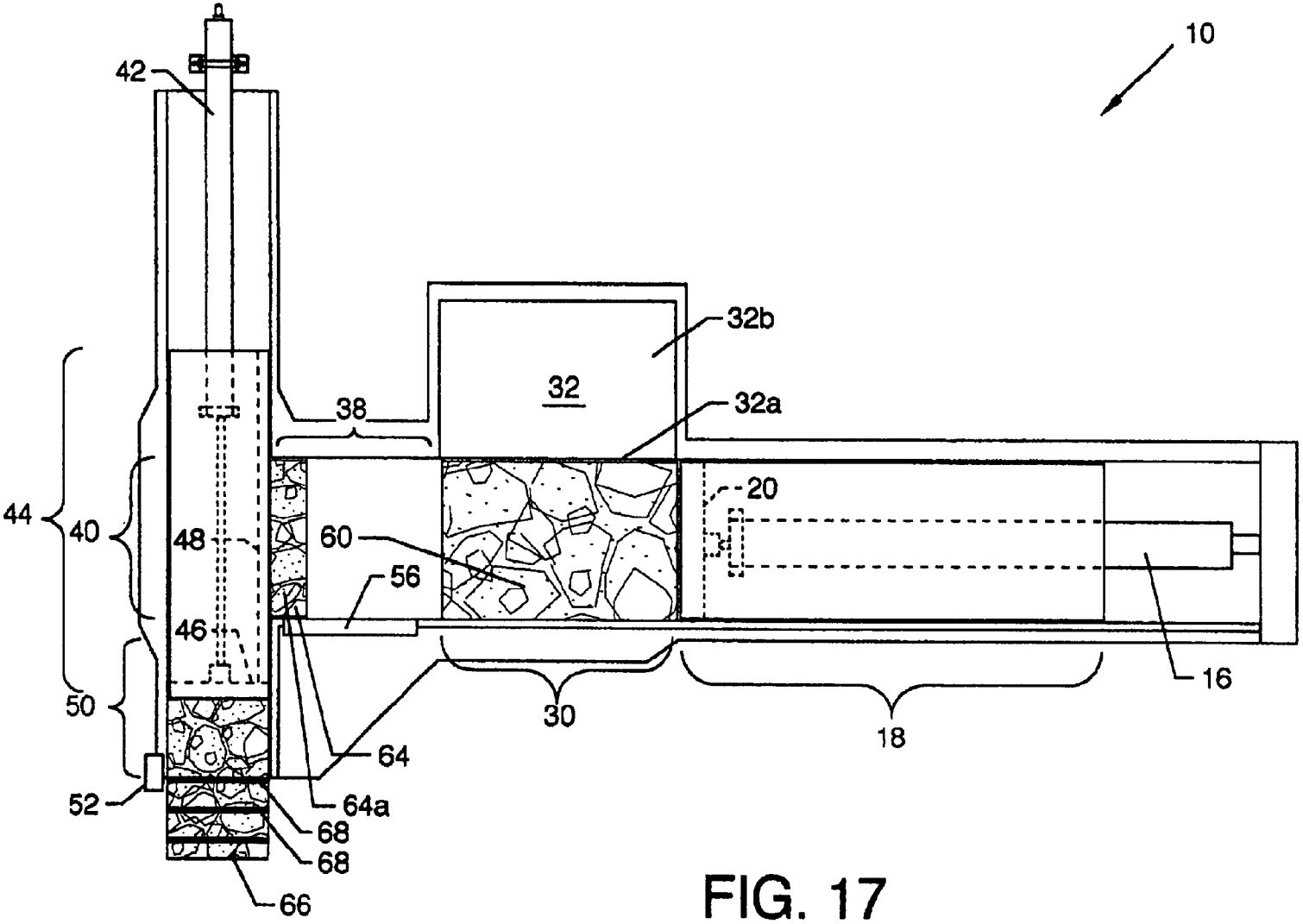
Figure 18:
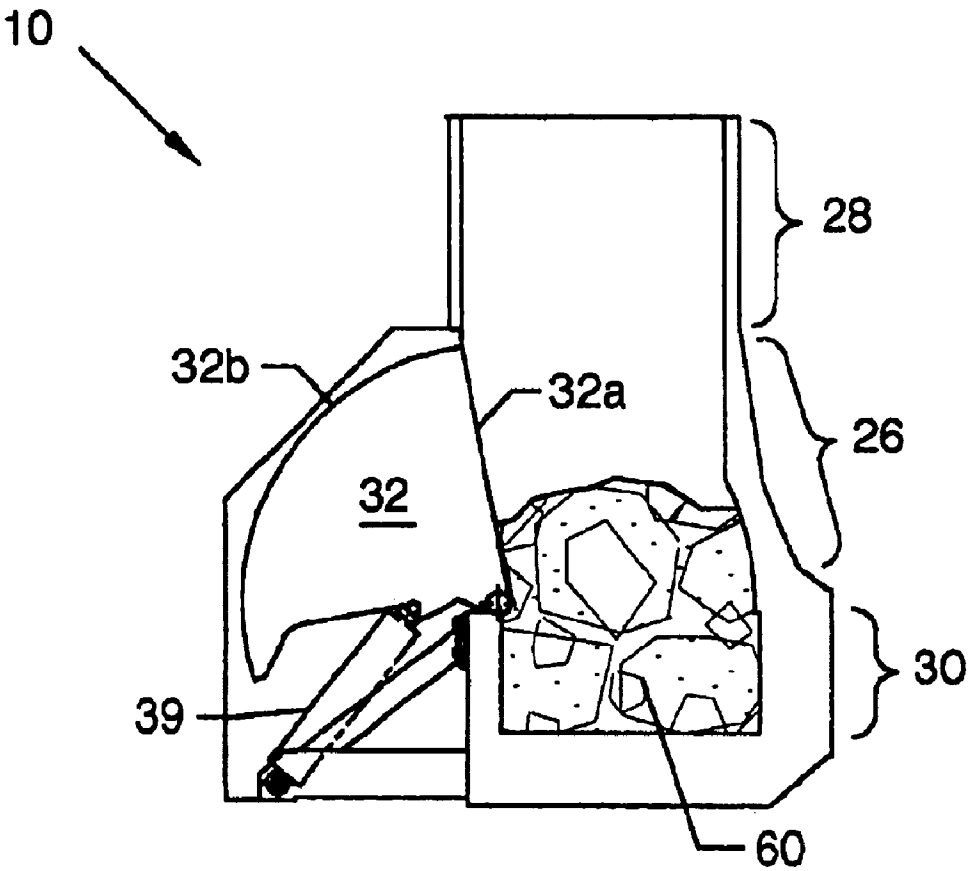
Figure 19:
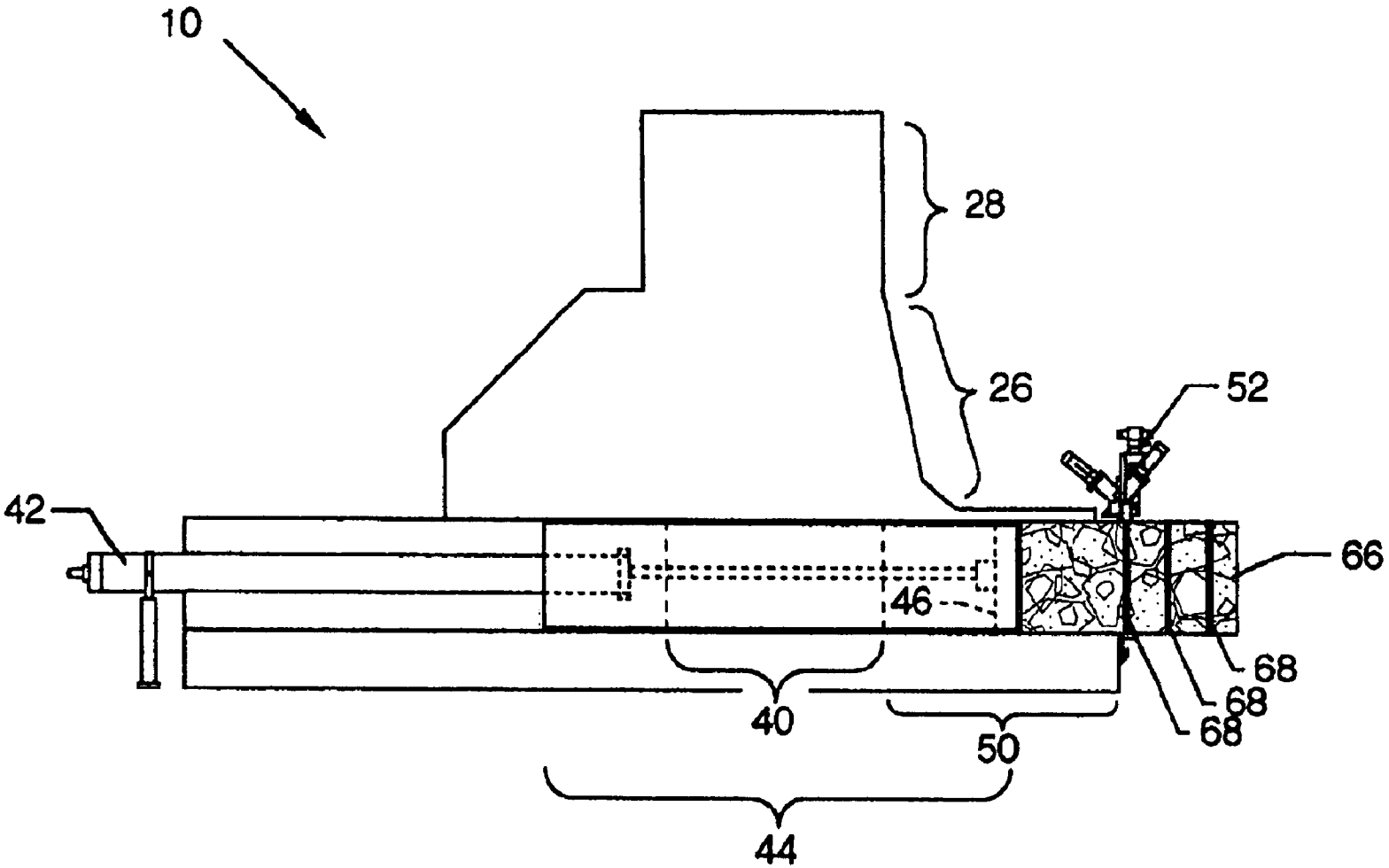
Figure 20:
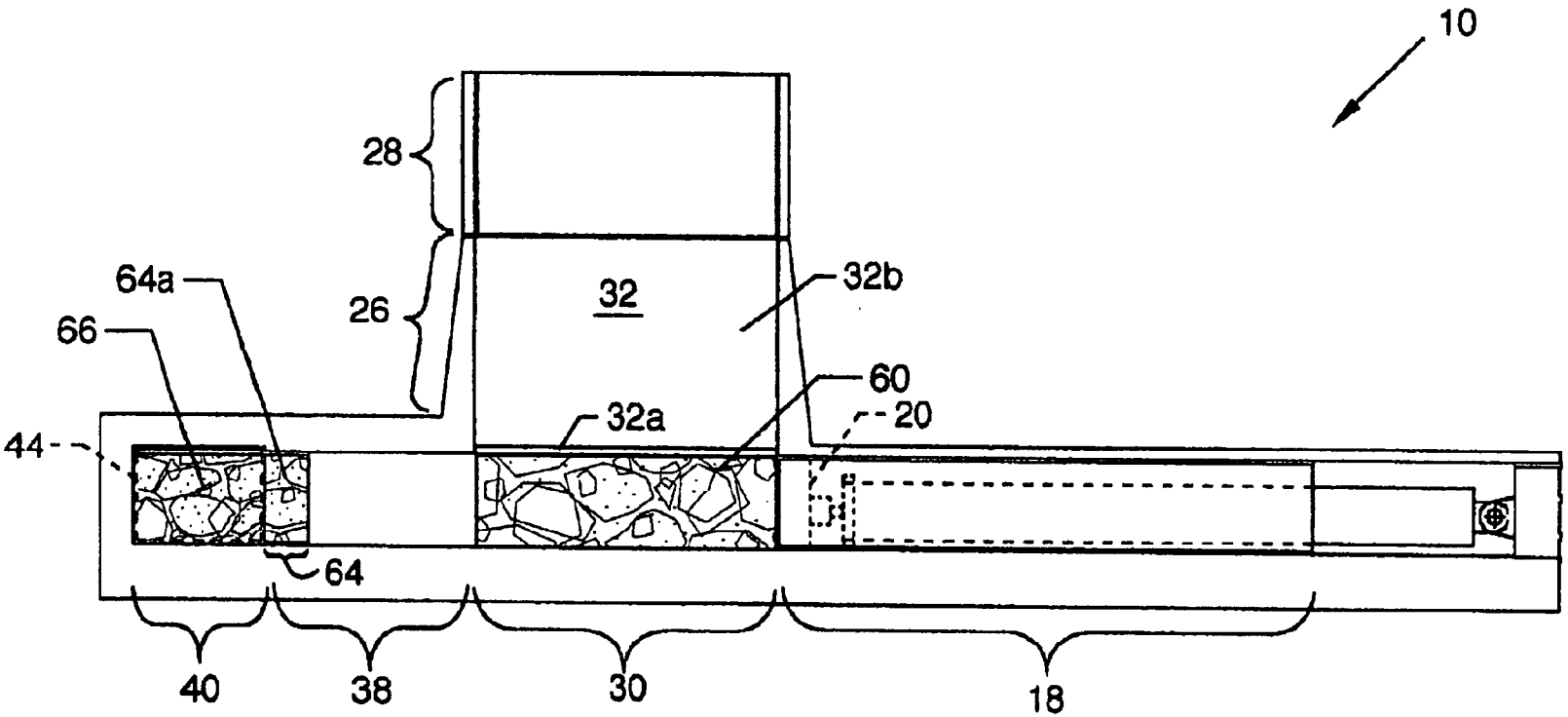
Figure 21:
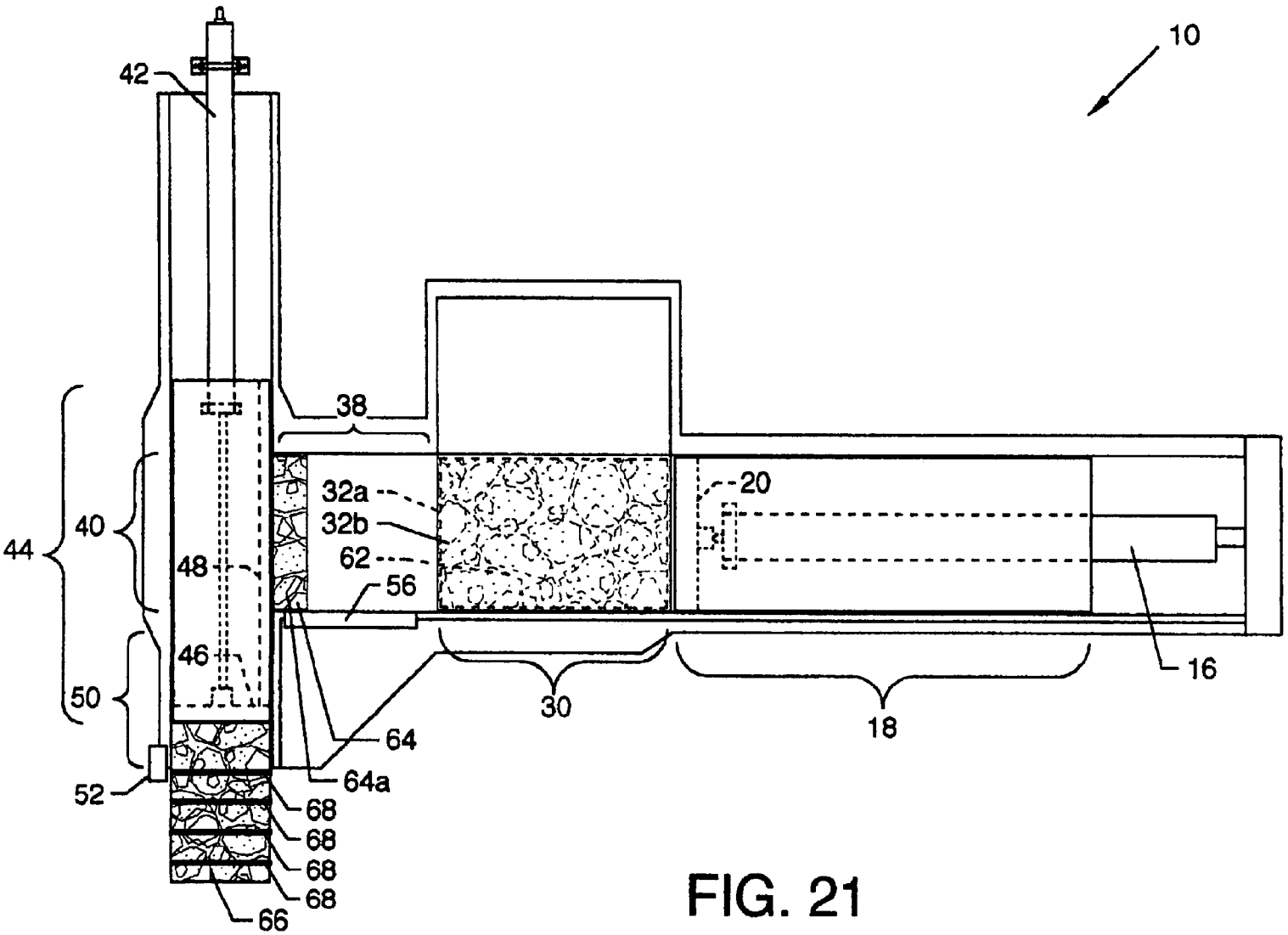
Figure 22:
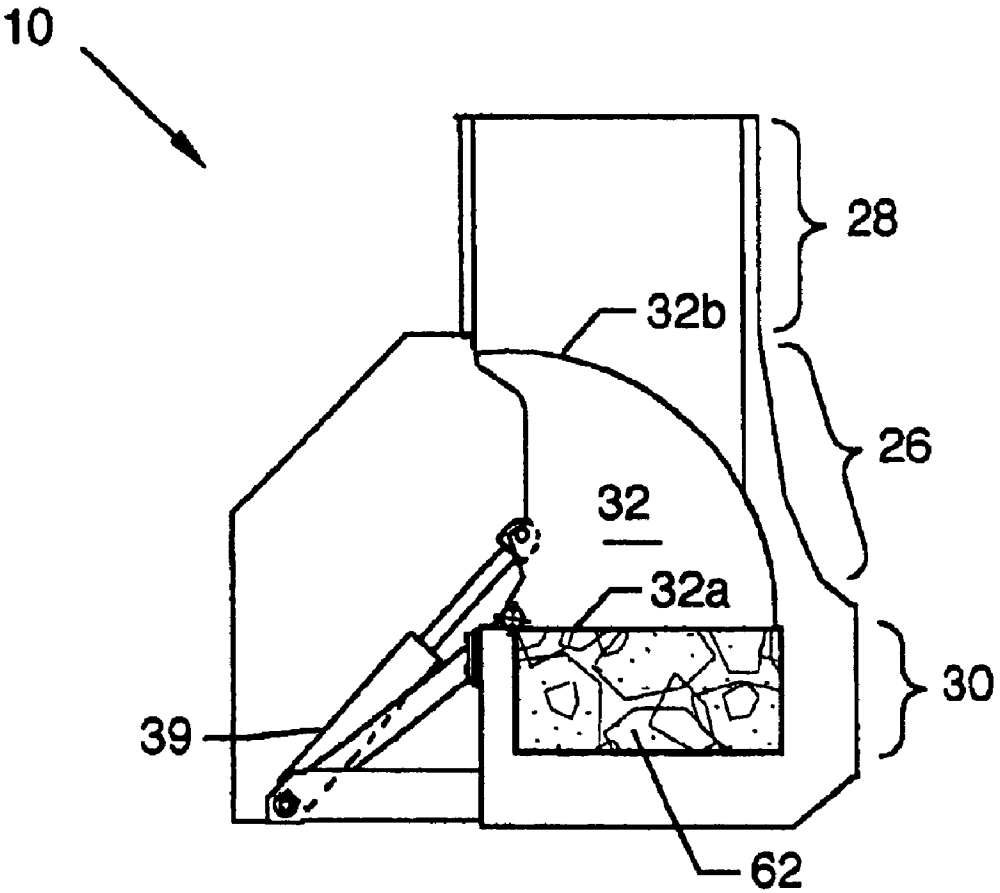
Figure 23:
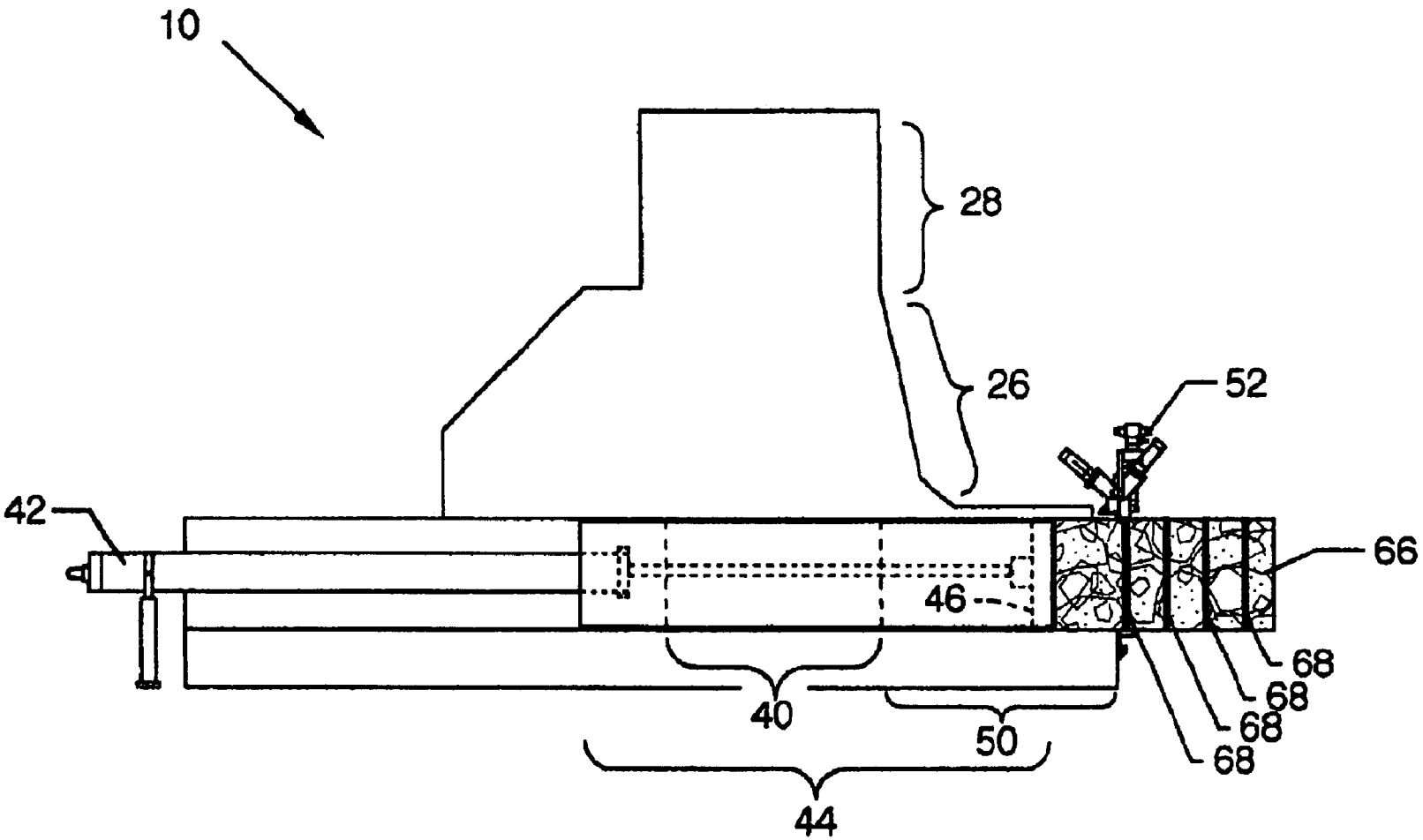
Figure 24:
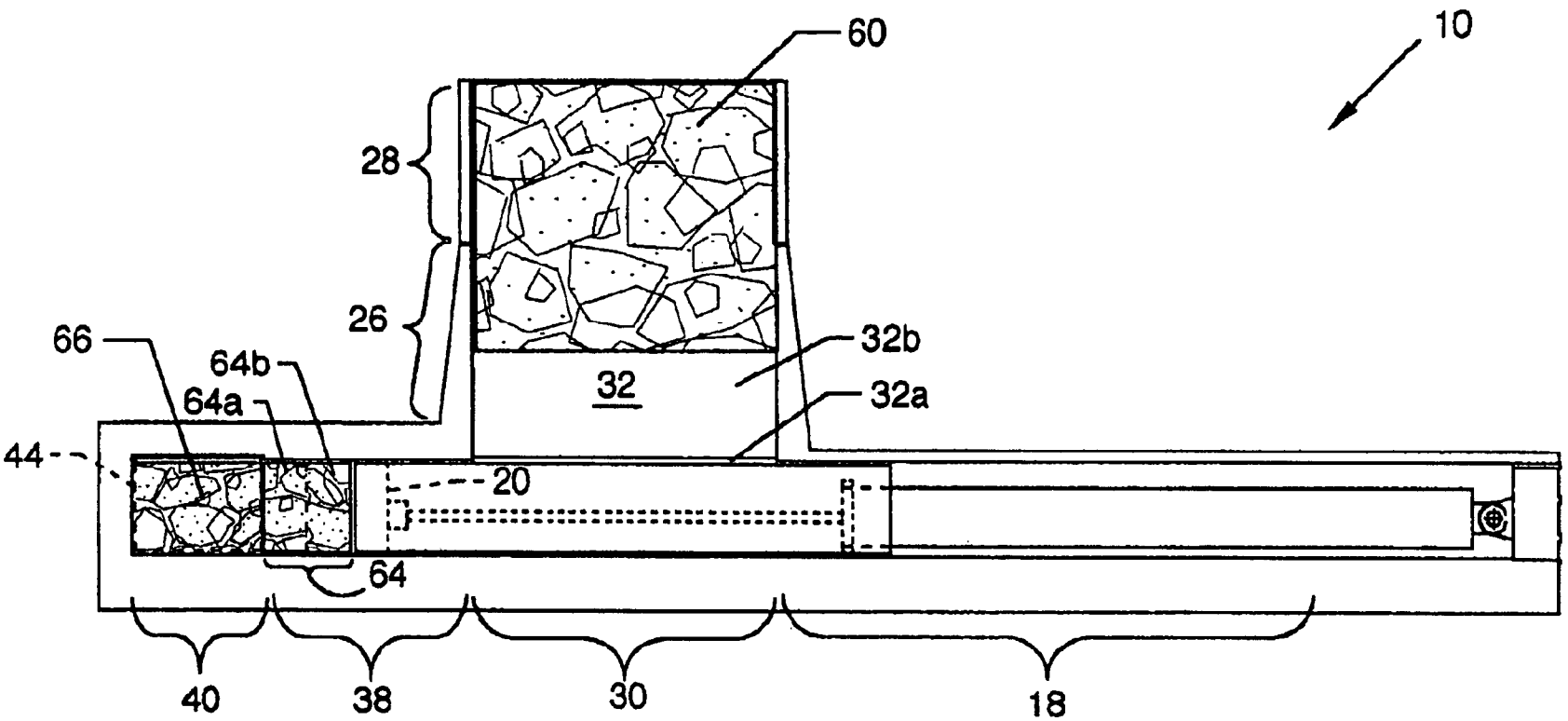
Figure 25:
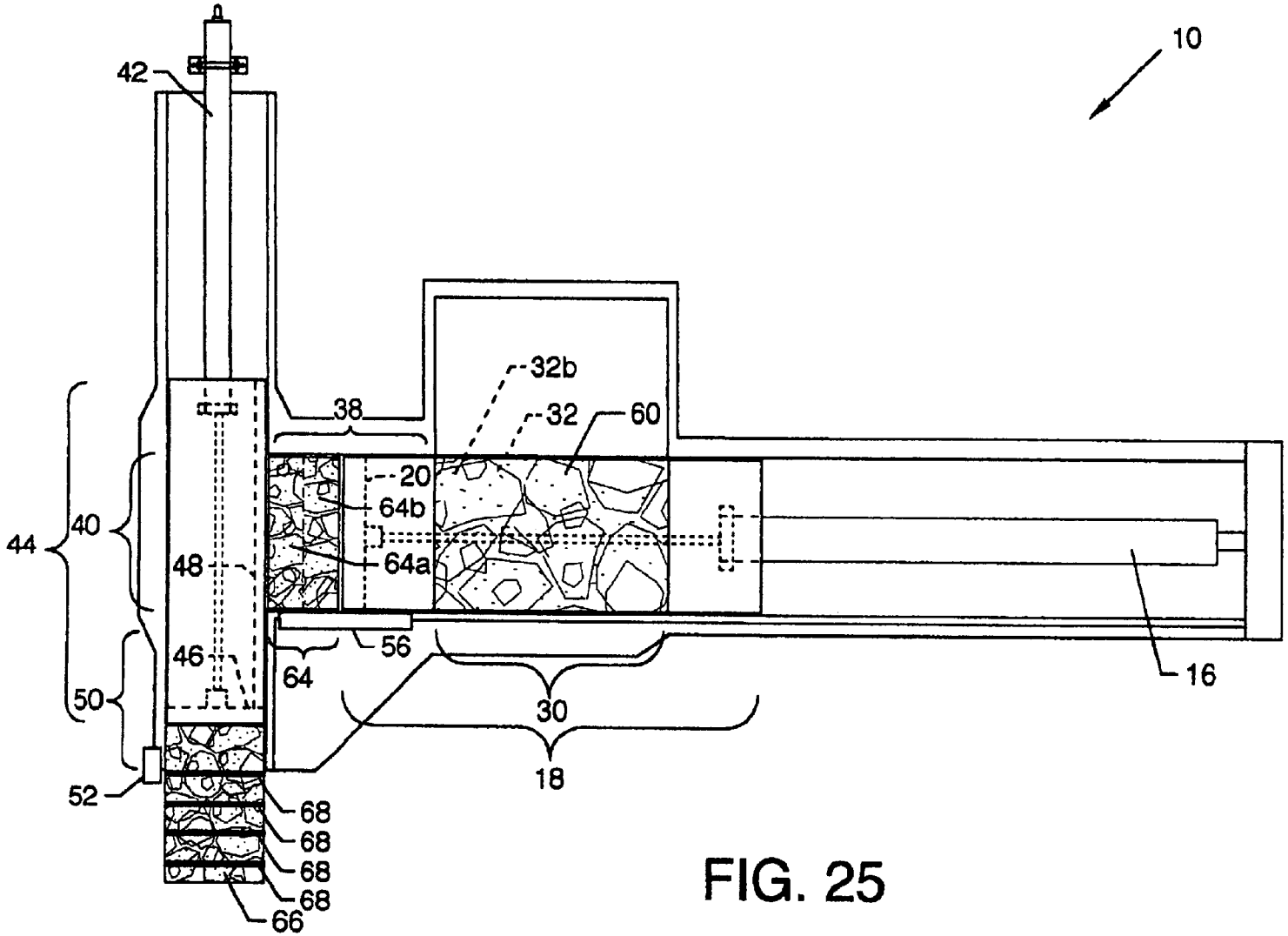
Figure 26:
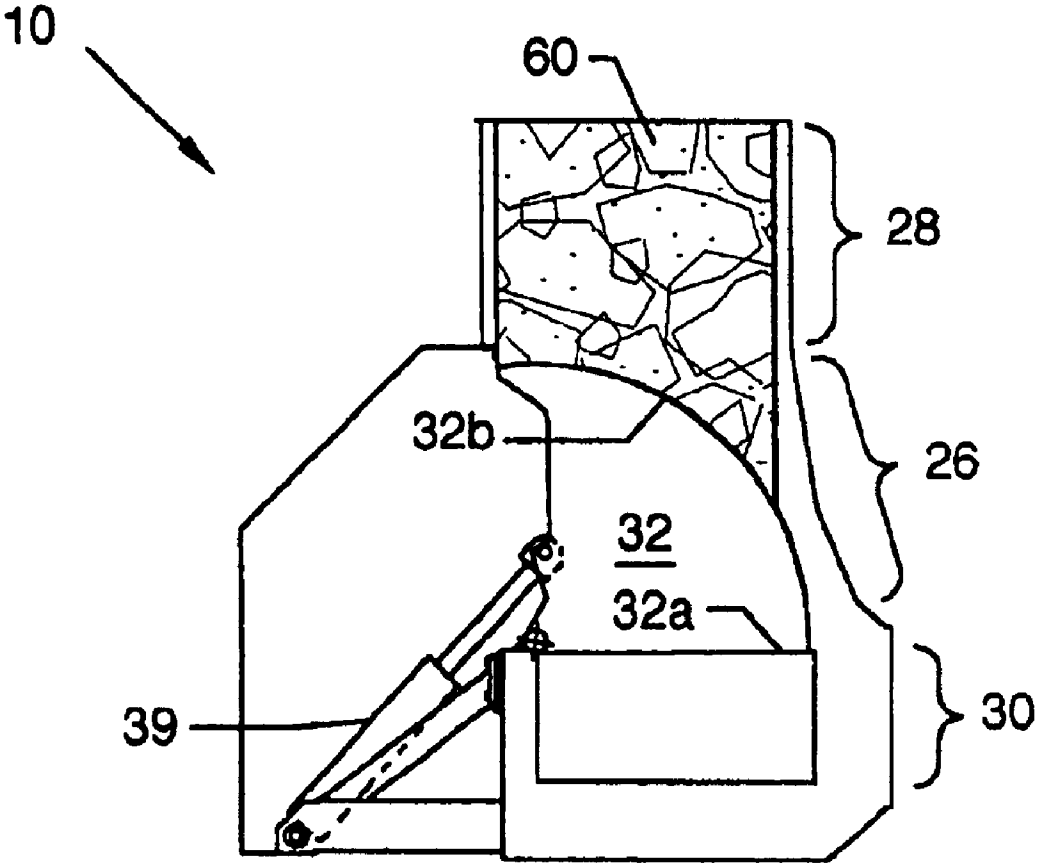
Figure 27:
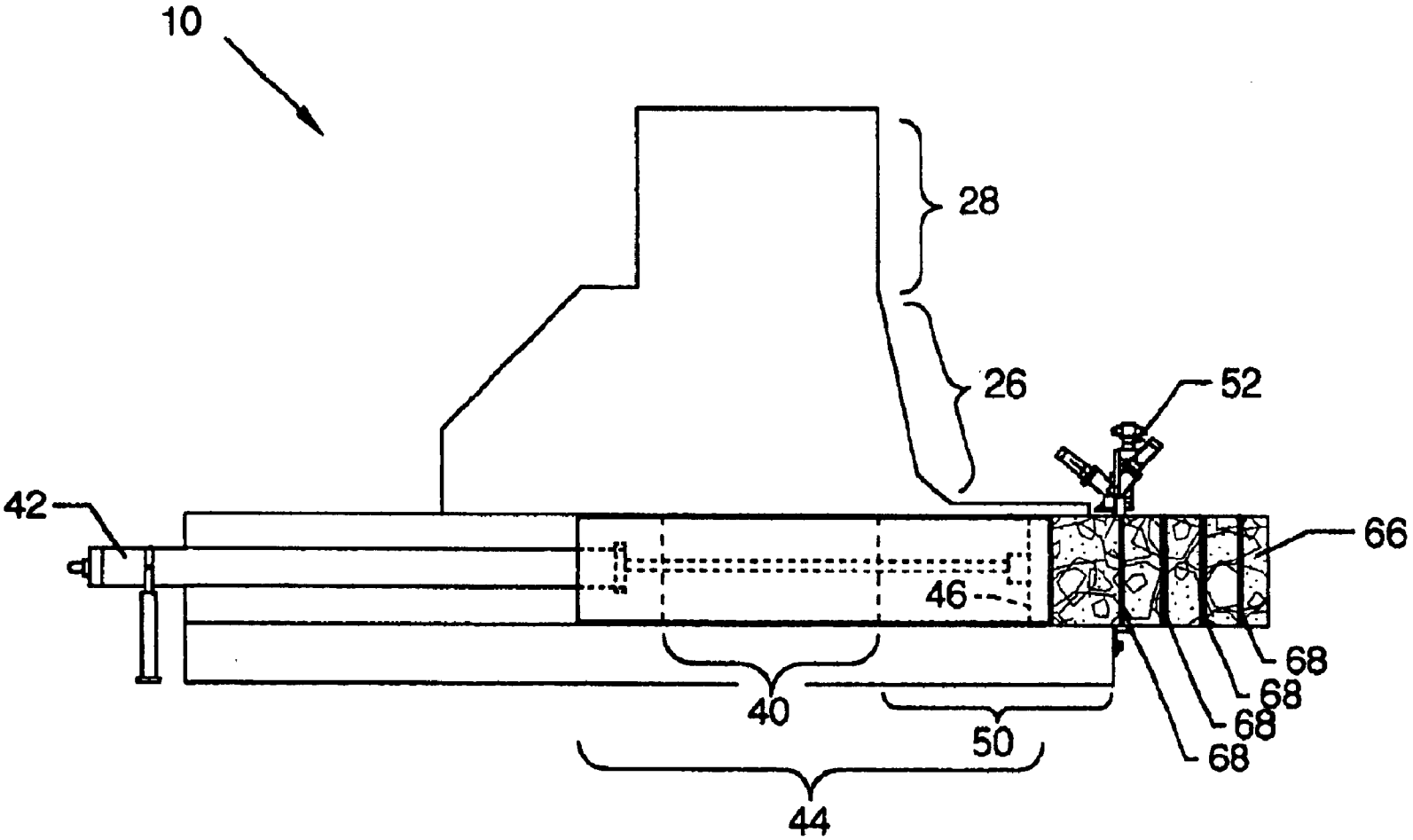
Figure 28:
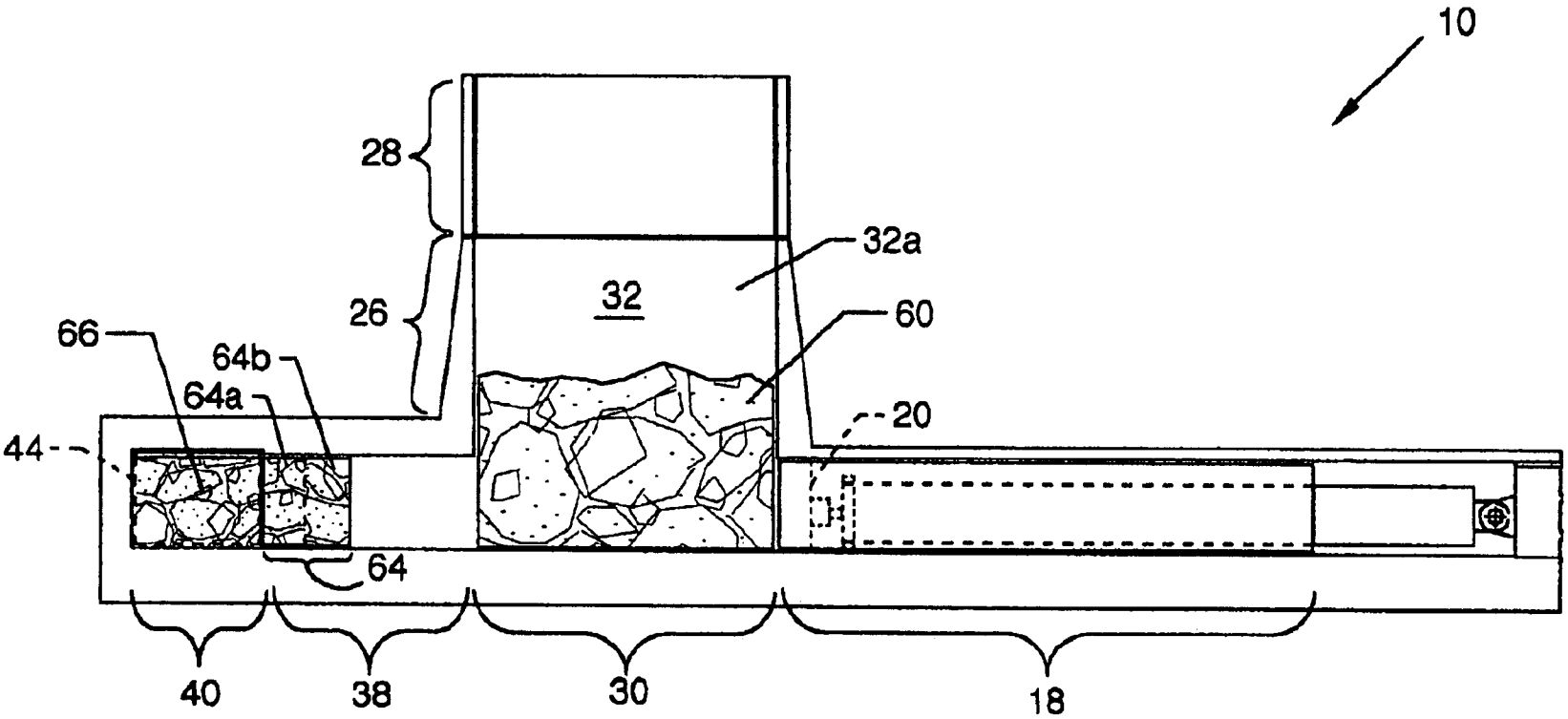
Figure 29:
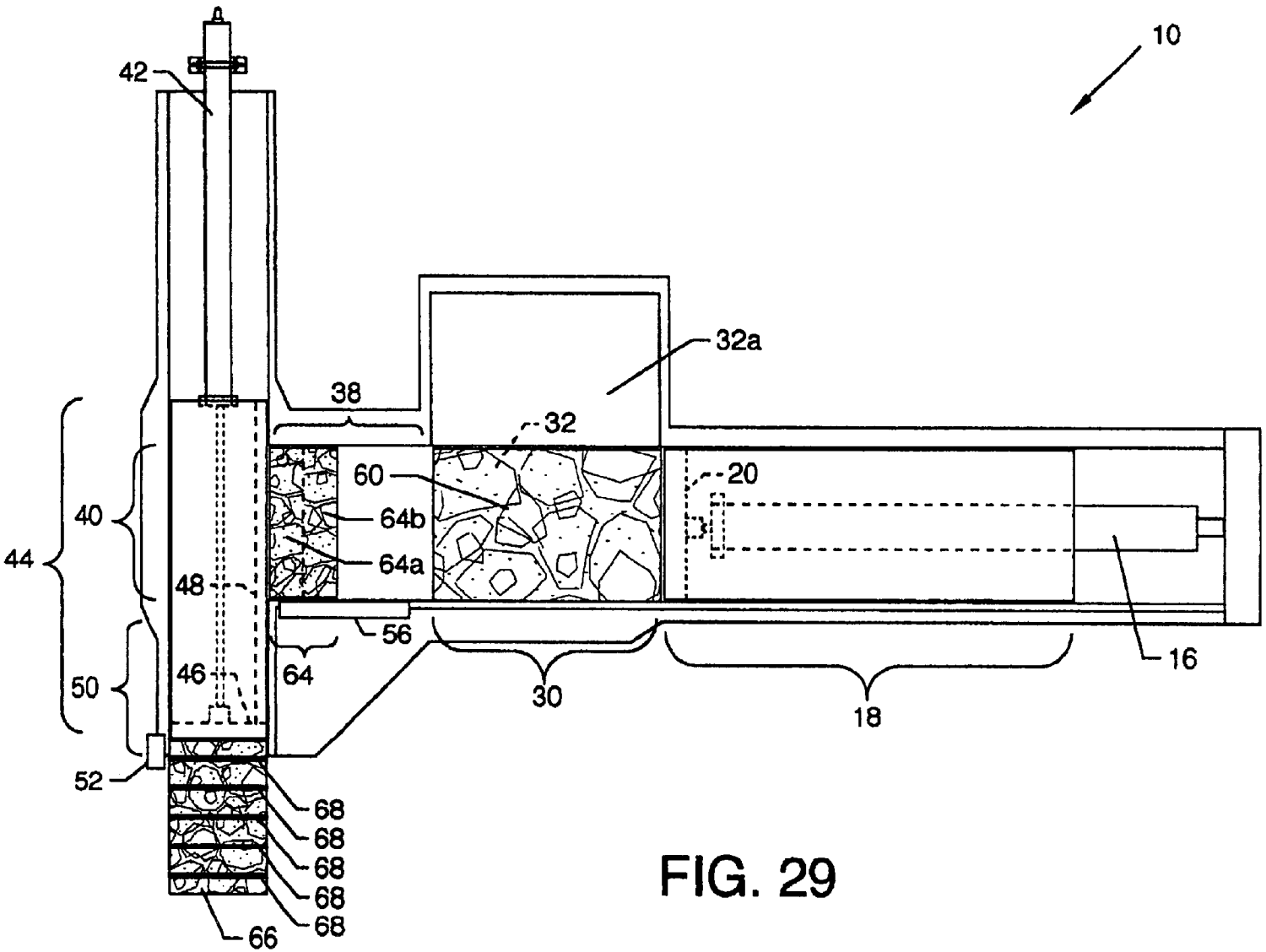
Figure 30:
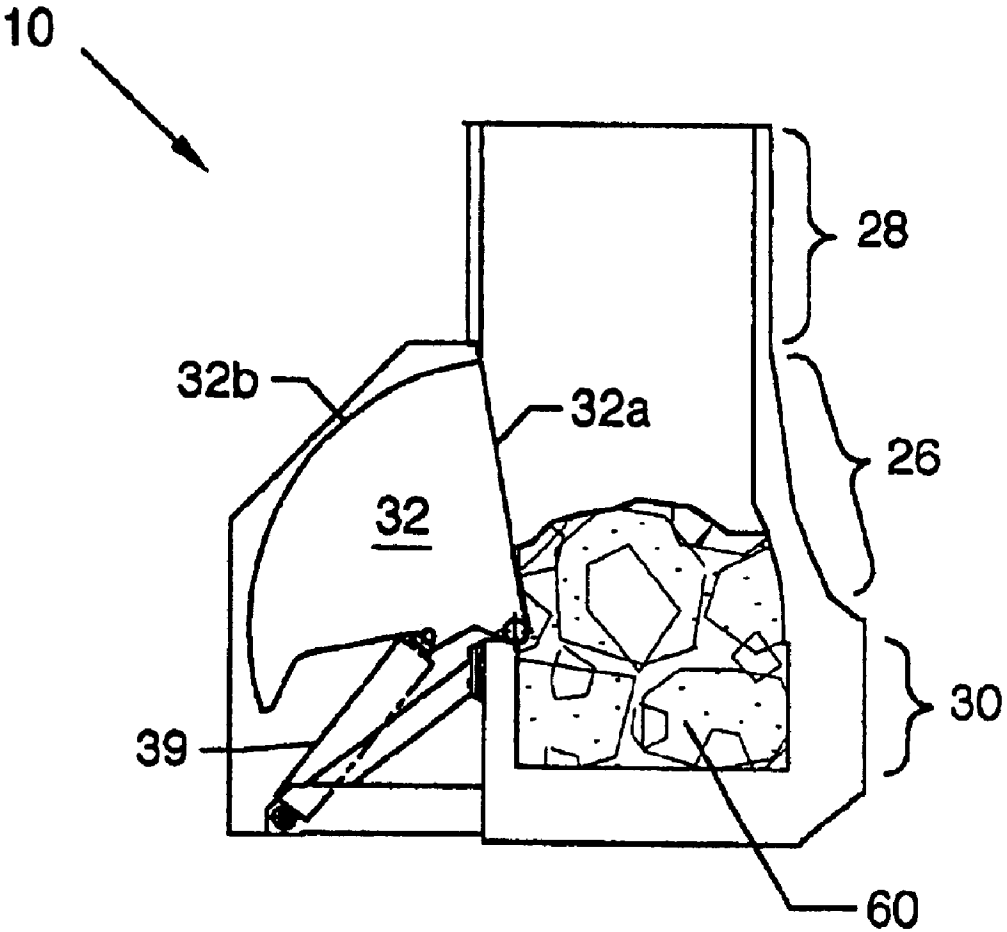
Figure 31:
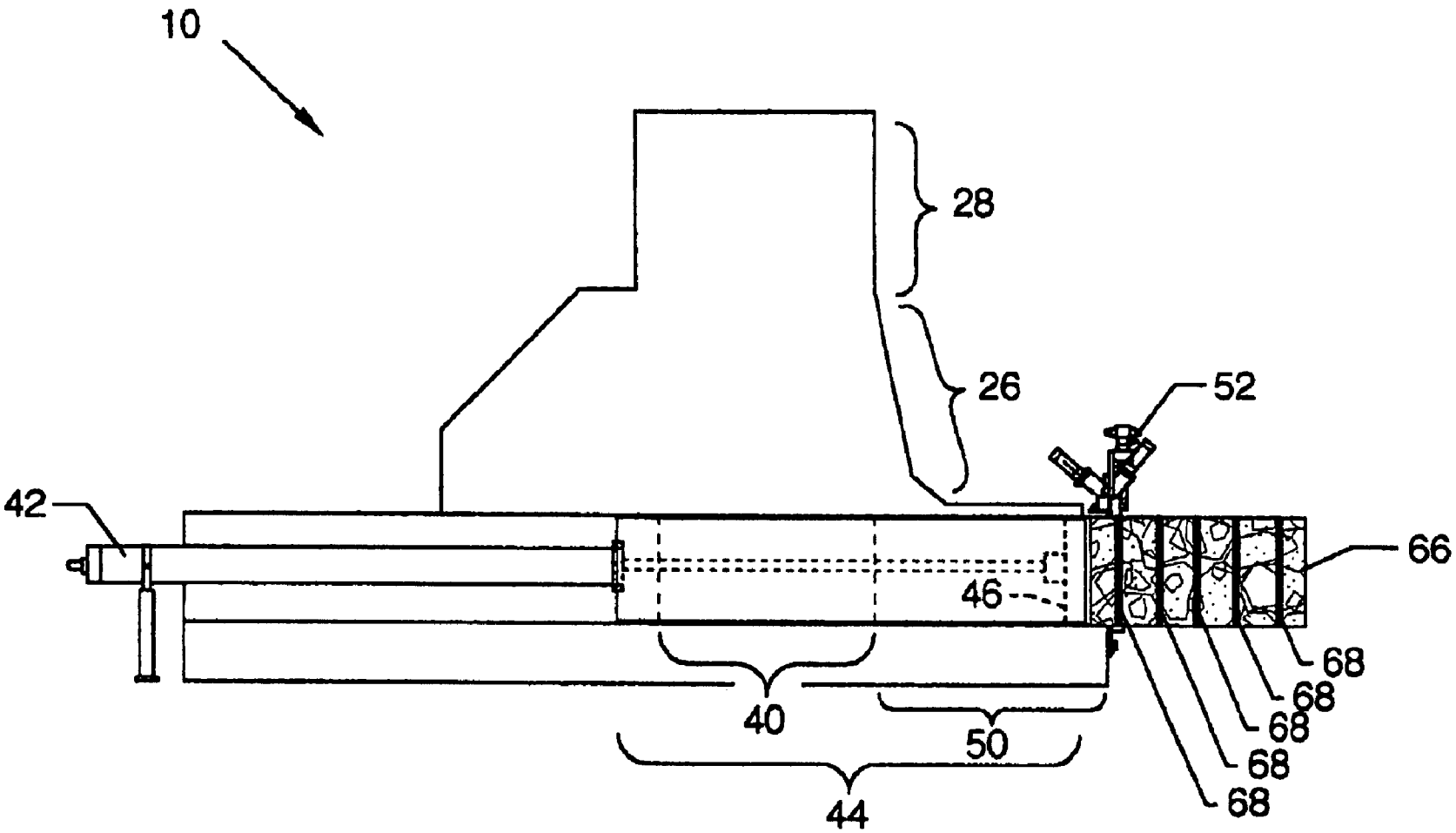
Figure 32:
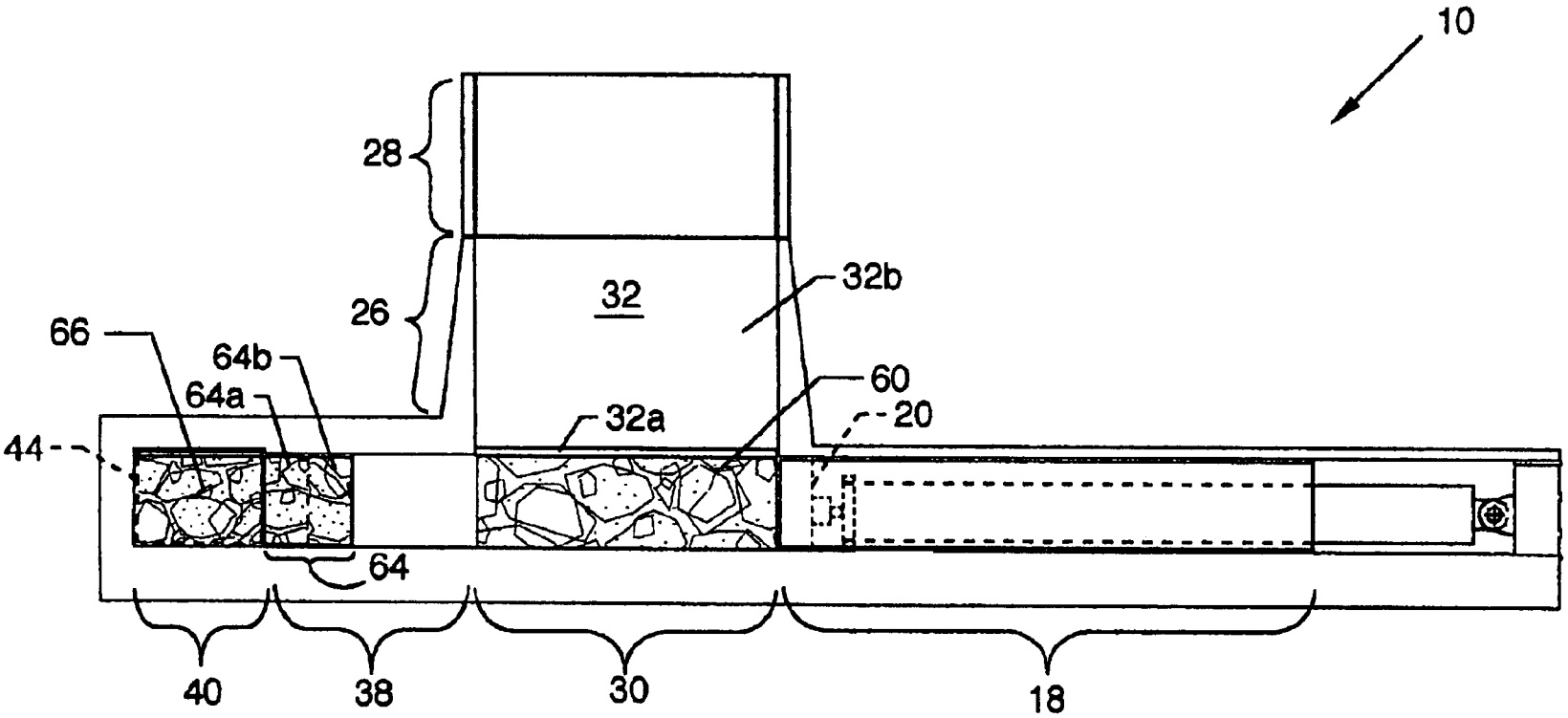
Figure 33:
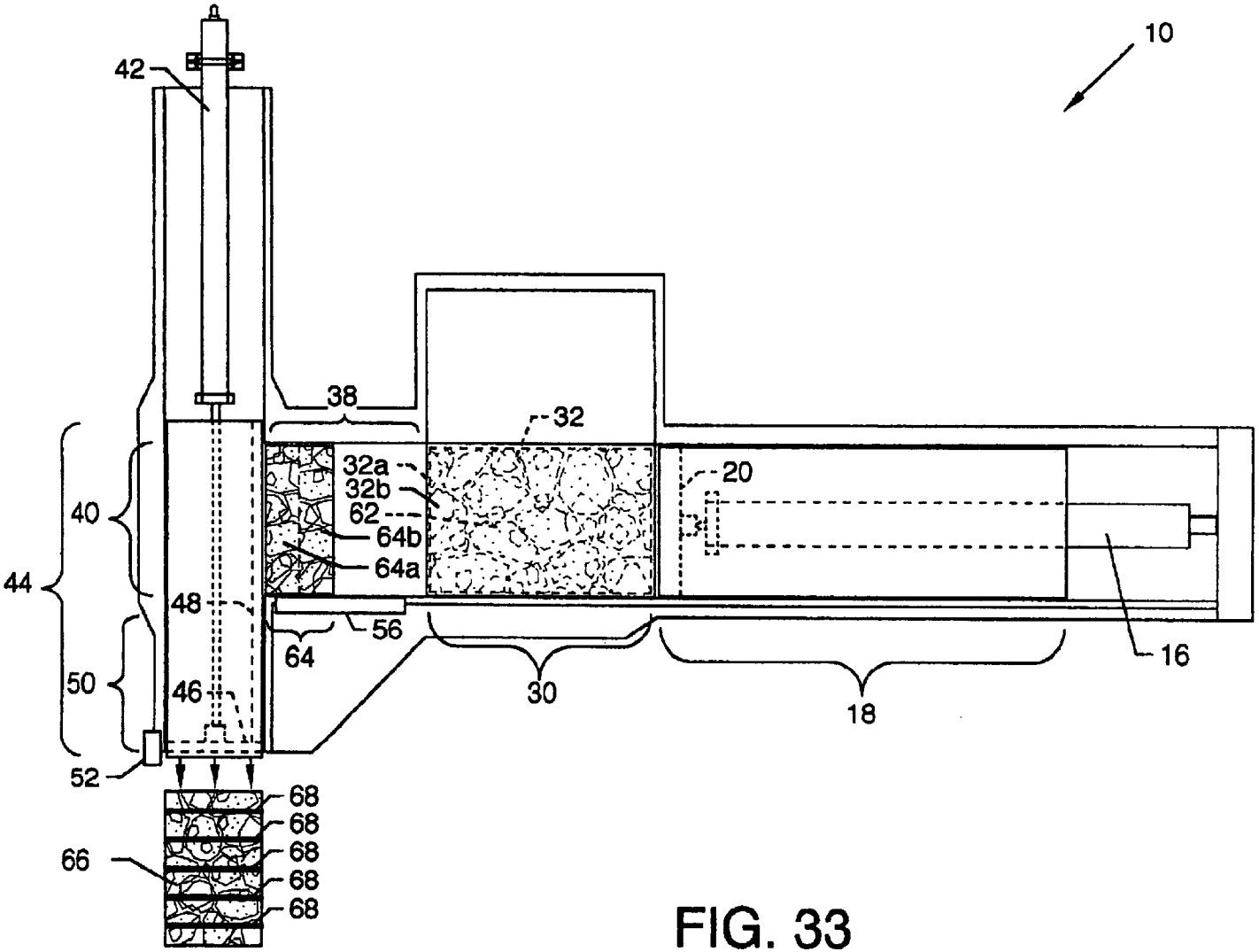
Figure 34:
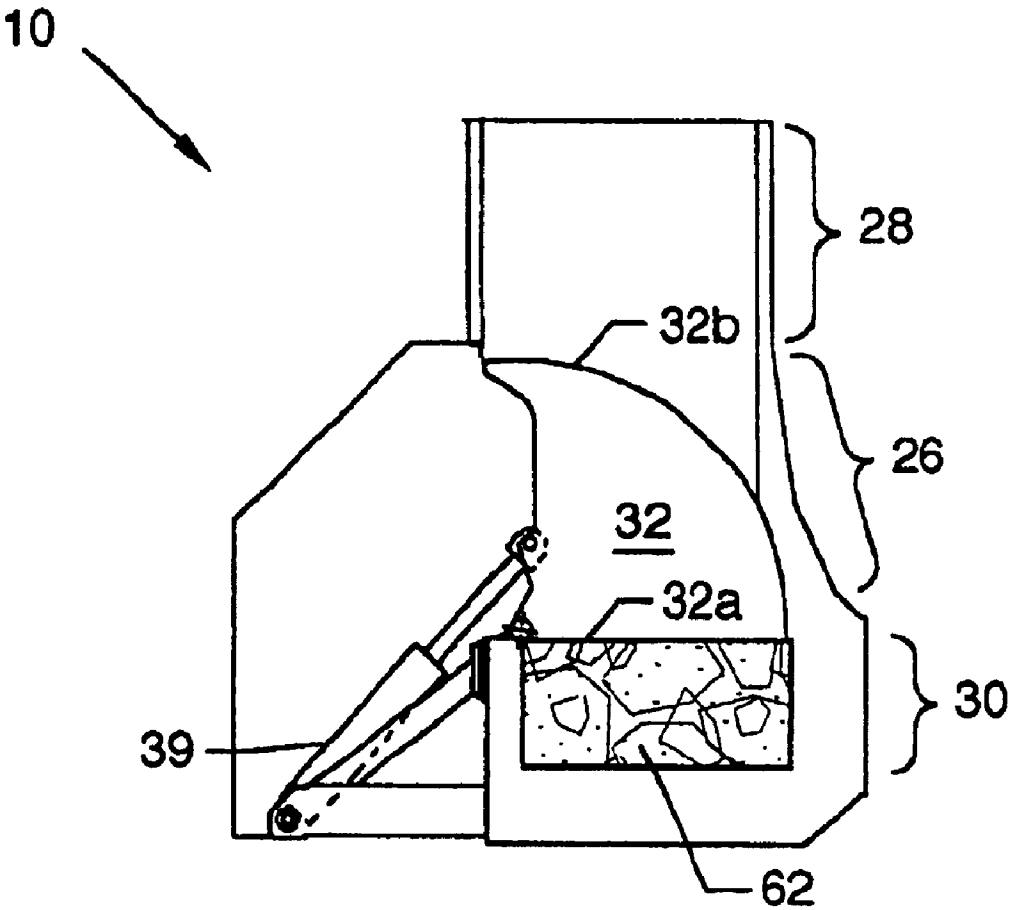
Figure 35:
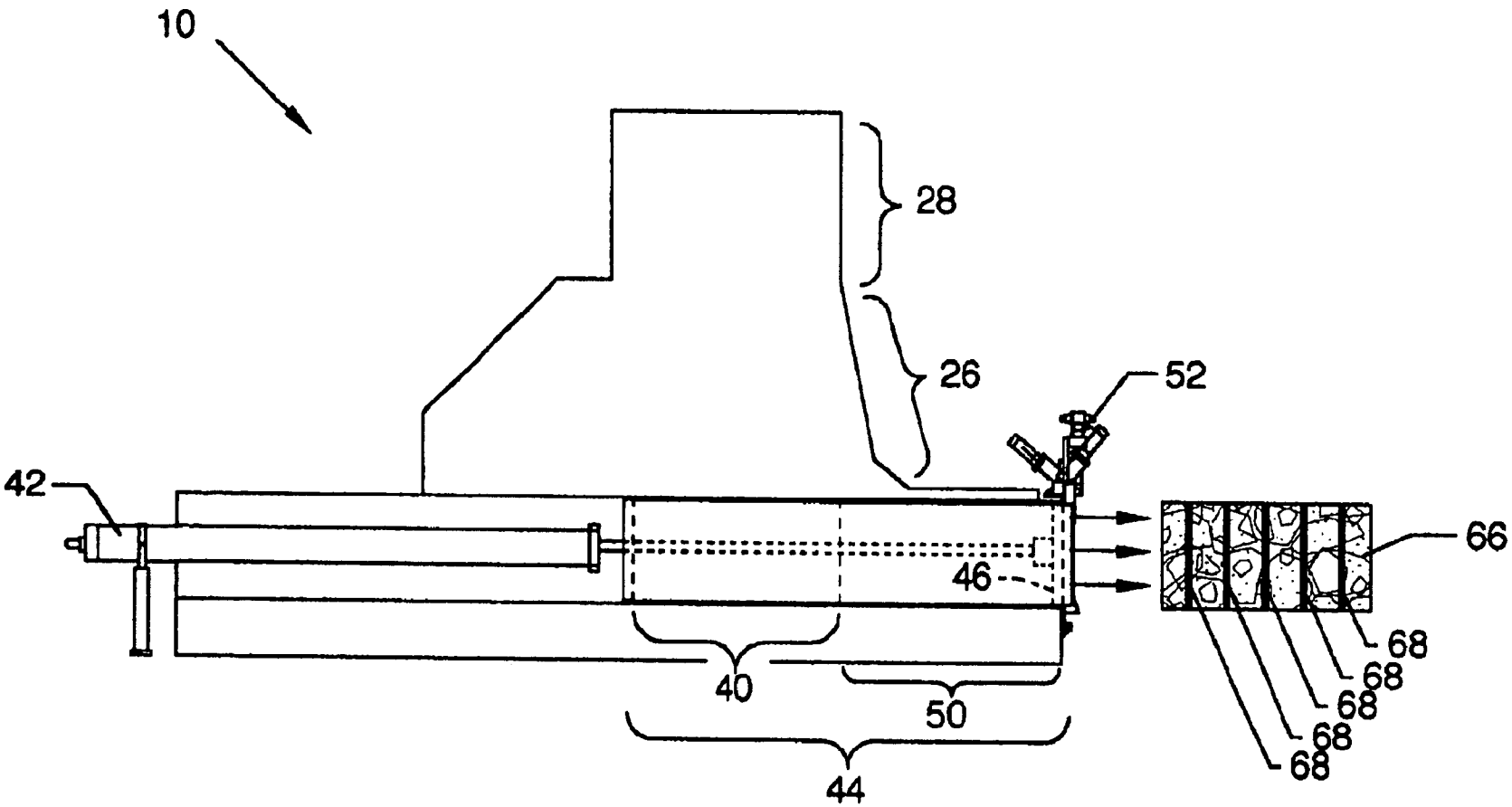

Other aspects of the multi-ram bale and tie baler system 10 include a sequence of operational steps for the baling of waste materials where multiple groups of four simplified illustrations in partial cutaway show the functional position of key components and of waste material during the continual baling process. The first group of illustrations is FIGS. 4, 5, 6 and 7 where FIG. 4 is a side view; FIG. 5 is a top view; FIG. 6 is a mid-section view through the hopper 26, the hopper extension 28 and the pre-compress chamber 30; and FIG. 7 is an end view looking at the ejector ram 44. The same sequence of views repeats and follows with a second group of illustrations corresponding to the first group of illustrations showing FIGS. 8, 9, 10 and 11 where FIG. 8 is a side view; FIG. 9 is a top view; FIG. 10 is a mid-section view through the hopper 26, the hopper extension 28, and the pre-compress chamber 30; and FIG. 21 is an end view looking at the ejector ram 44. Such ordered sequencing repeats itself in a similar fashion until reaching the final group of illustrations, FIGS. 36, 37, 38 and 39, showing the final sequence. Throughout the ordered sequences waste material undergoes various steps and stages of compression and is referred to as waste 60 which is waste not compressed in any fashion, pre-compressed waste 62 which is waste which has been partially compressed such as by the pre-compress lid 32, and first through last units of compressed waste 64*a*–64*n* each of which is pre-compressed waste 62 forcibly compressed in steps by the gatherer ram 18 to form a newly formed bale 64 in continuous and simultaneous progression. In the alternative, compressed units of waste 64*a*–64*n* can be waste 60 which is forcibly compressed only by the gatherer ram 18. Throughout various steps in the sequence of operational steps, the gatherer ram 18 and the ejector ram 44 are advanced or retracted incrementally or fully and the pre-compress lid 32 is opened or closed to form multiple newly formed bales 64. The strapper 52 is activated simultaneously to strap a previously formed bale 66 in incremental stages in continuous and simultaneous progression while other steps are involved in the creation of a newly formed bale 64 in continuous and simultaneous progression. A previously formed bale 66 is driven in continuous and simultaneous progression through the bale exit chamber 50 by the ejector ram 44.

Figure 36:
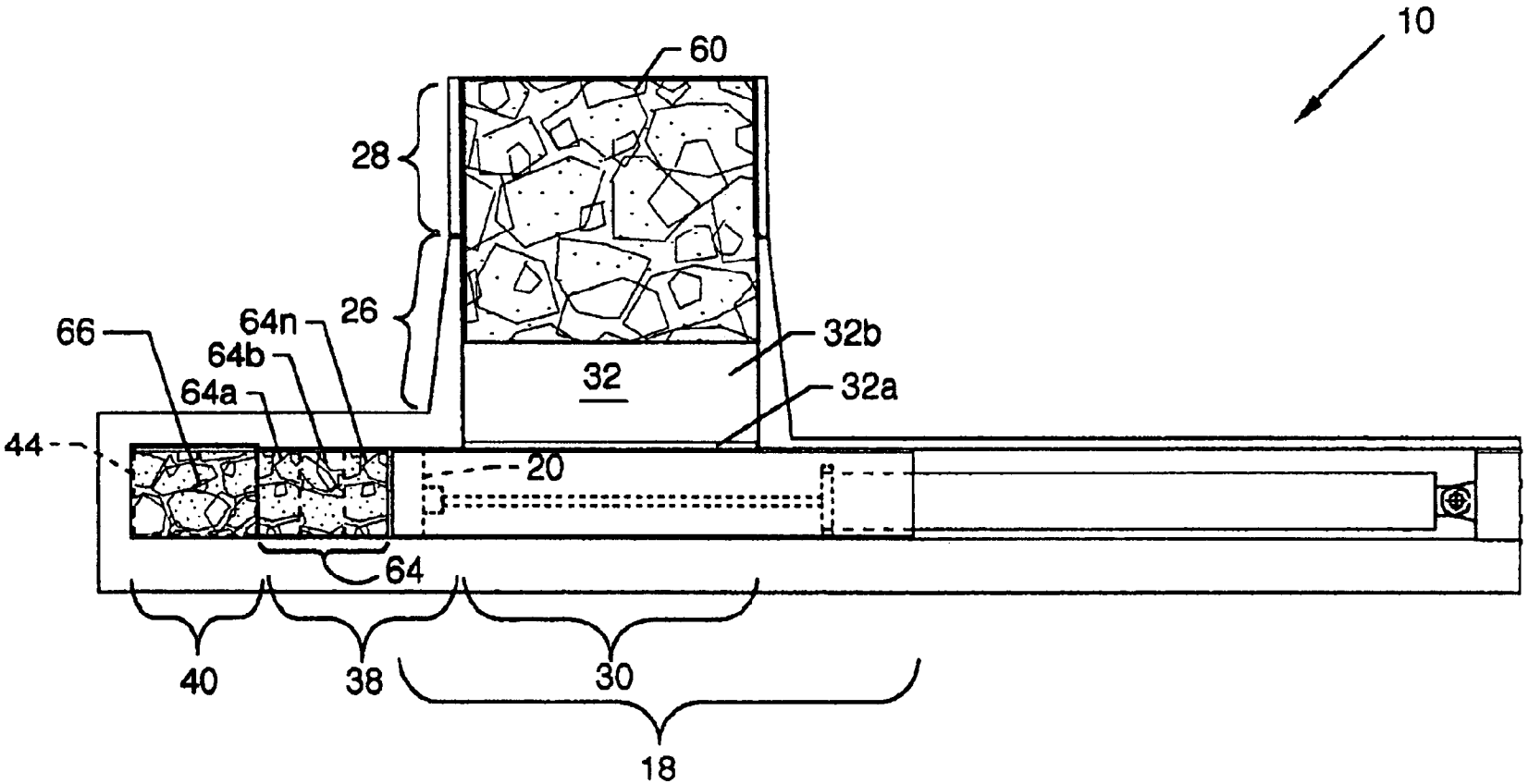
Figure 37:
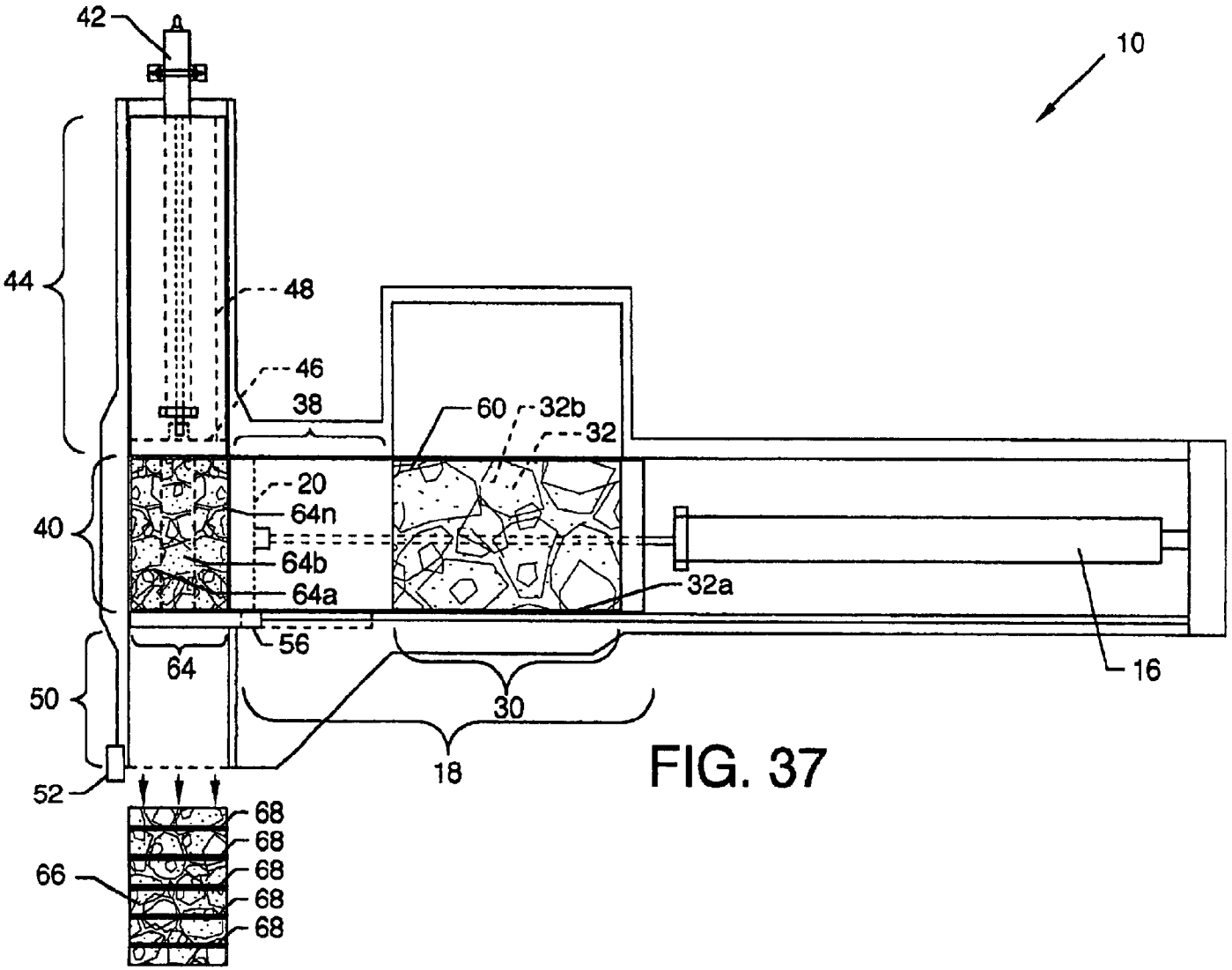
Figure 38:
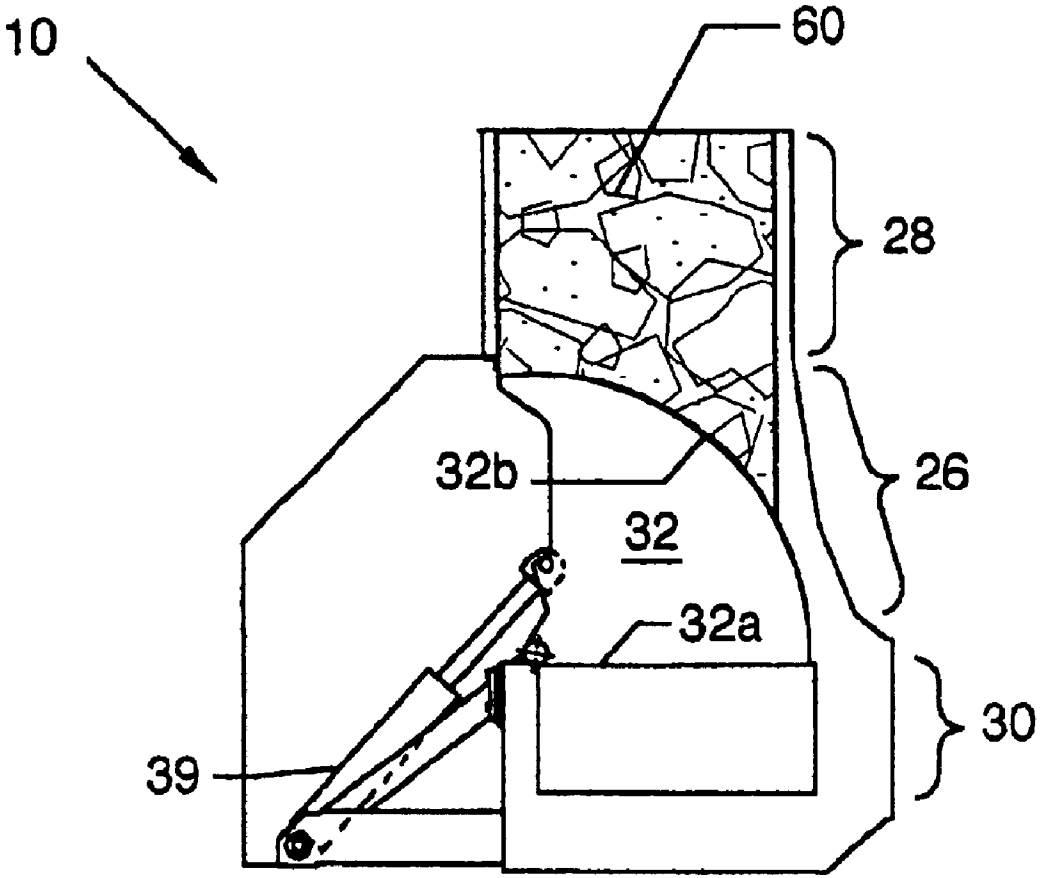
Figure 39:
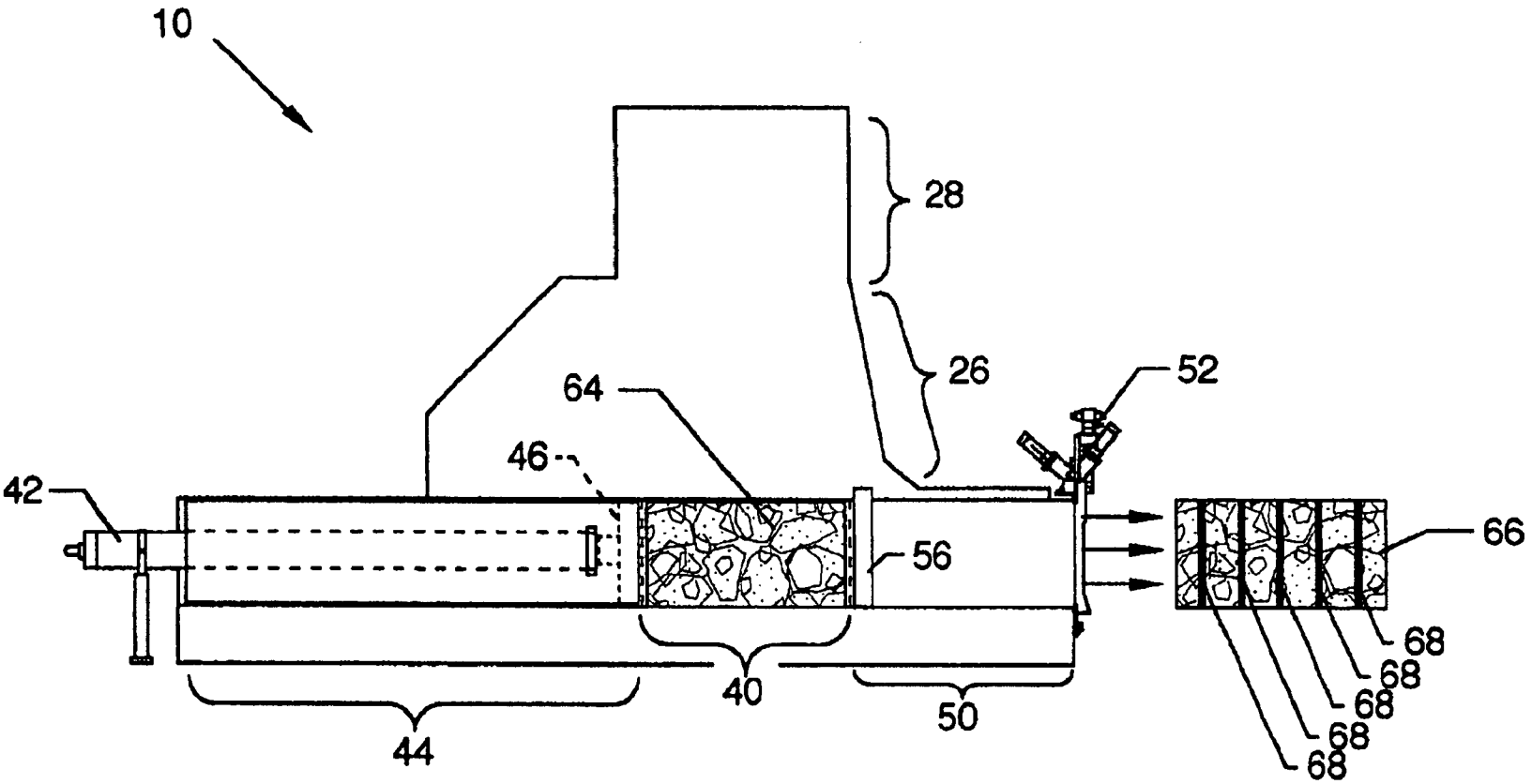

Best understanding of the operational steps for using the multi-ram bale and tie baler system 10 is accomplished by first referring to FIGS. 36, 37, 38 and 39, the last group of illustrations which show the operational steps just prior to the operational steps shown in the FIGS. 4, 5, 6 and 7 illustration group during the continuous progression. It is to be noted in FIGS. 36 and 38 that waste 60 is held in the hopper extension 28 by the pre-compress lid 32 being rotatingly positioned into the hopper 26. A previously formed bale 66 has been ejected from the bale exit chamber 50 as shown in FIG. 37 and a newly formed bale 64 having been formed in its final stage is residing in the secondary bale chamber 40 awaiting urging towards the bale exit chamber 50 by the ejector ram 44 as shown in FIGS. 37 and 39. Then, with reference to the FIGS. 4, 5, 6 and 7 illustration group, the operational steps are described where:

The ejector ram 44 advances to contact and incrementally urge a previously formed bale 66 along the bale exit chamber 50 to a first position beneath the strapper 52. The strapper 52 applies a first strap 68 around and about the first portion of a previously formed bale 66 at the first position. The gatherer ram 18 retracts. The pre-compress lid 32 opens allowing waste 60 to enter the pre-compress chamber 30.

With reference to the FIGS. 8, 9, 10 and 11 illustration group, the operational steps are further described where:

Simultaneously, the pre-compress lid 32 closes sealing the bottom region of the hopper extension 28 and sealing the upper region of the pre-compress chamber 30 to form waste 60 into pre-compressed waste 62, and the ejector ram 44 advances incrementally to urge a previously formed bale 66 along the bale exit chamber 50 to a second position beneath the strapper 52. The strapper 52 applies a second strap 68 around and about a second portion of a previously formed bale 66 at a second position.

With reference to the FIGS. 12, 13, 14 and 15 illustration group, the operational steps are further described where:

The gatherer ram 18 advances to urge pre-compressed waste 62 from the pre-compress chamber 30 into the primary bale chamber 38 and against the ejector ram 44, being part of the primary bale chamber 38, to form a first unit of compressed waste 64*a*, thus partially forming a newly formed bale 64. Waste 60 loads into the hopper extension 28 such as by an external conveyor (not shown).

With reference to the FIGS. 16, 17, 18 and 19 illustration group, the operational steps are further described where:

The gatherer ram 18 retracts. The pre-compress lid 32 opens to allow waste 60 in the hopper extension 28 to be deposited in the pre-compress chamber 30. During gatherer ram 18 retraction and pre-compress lid 32 opening, the ejector ram 44 is advanced incrementally to urge a previously formed bale 66 along the bale exit chamber 50 to a third position beneath the strapper 52. The strapper 52 applies a third strap 68 around and about a third portion of a previously formed bale 66 at a third position.

With reference to the FIGS. 20, 21, 22 and 23 illustration group, the operational steps are further described where:

Simultaneously, the pre-compress lid 32 closes sealing the bottom region of the hopper extension 28 and sealing the upper region of the pre-compress chamber 30 to form waste 60 into pre-compressed waste 62, and the ejector ram 44 advances incrementally to urge a previously formed bale 66 along the bale exit chamber 50 to a fourth position beneath the strapper 52. The strapper 52 applies a fourth strap 68 around and about a fourth portion of a previously formed bale 66 at a fourth position.

Sequential operational steps described in illustration groups found in FIGS. 24–39 may be reduced or increased depending on the density and the composition of the waste material 60.

With reference to the FIGS. 24, 25, 26 and 27 illustration group, the operational steps are further described where:

The gatherer ram 18 advances to urge pre-compressed waste 62 from the pre-compress chamber 30 into the primary bale chamber 38 against the first unit of compressed waste 64*a* to form a second unit of compressed waste 64*b* and to combine with the first unit of compressed waste 64*a*, thus partially and additionally contributing to the formation of the newly formed bale 64. Waste 60 loads into the hopper extension 28 such as by an external conveyor (not shown).

With reference to the FIGS. 28, 29, 30 and 31 illustration group, the operational steps are further described where:

The gatherer ram 18 retracts. The pre-compress lid 32 opens to allow waste 60 in the hopper extension 28 to be deposited in the pre-compress chamber 30. During the gatherer ram 18 retraction and pre-compress lid 32 opening the ejector ram 44 advances incrementally to urge a previously formed bale 66 along the bale exit chamber 50 to a fifth position beneath the strapper 52. The strapper 52 applies a fifth strap 68 around and about a fifth portion of a previously formed bale 66 at the fifth position.

With reference to the FIGS. 32, 33, 34 and 35 illustration group, the operational steps are further described where:

Simultaneously, the pre-compress lid 32 closes sealing the bottom region of the hopper extension 28 and sealing the upper region of the pre-compress chamber 30 to form waste 60 into pre-compressed waste 62, and the ejector ram 44 advances incrementally to urge a fully strapped previously formed bale 66 along and beyond the bale exit chamber 50.

With reference to the FIGS. 36, 37, 38 and 39 illustration group, the operational steps are further described where:

The ejector ram 44 retracts, thus providing communication between the primary bale chamber 38 and the secondary bale chamber 40. The ejector ram 44 retracts a sufficient distance to allow the ejector ram front plate 46 to form one side of the secondary bale chamber 40, and the bale door 56 is closed to form another side of the secondary bale chamber 40, as shown in FIG. 37. The gatherer ram 18 advances to urge pre-compressed waste 62 from the pre-compress chamber 30 through the primary bale chamber 38 against the second unit of compressed waste 64*b*, as shown in FIG. 36.

The gatherer ram 18 urges the first unit of compressed waste 64*a*, the second unit of compressed waste 64*b* and the pre-compressed waste 62 into the secondary bale chamber 40 to form a last unit of compressed waste 64*n* from the pre-compressed waste 62 to combine the pre-compressed waste 62 directly with the second unit of compressed waste 64*b* as a last unit of compressed waste 64*n* and indirectly with the first unit of compressed waste 64*a*, thus fully and additionally contributing to the formation of a completed newly formed bale 66, as shown in FIG. 37. The bale door 56 opens. Simultaneously, during the gatherer ram 18 advancement and bale door 56 opening, the pre-compress lid 32 closes sealing the bottom region of the hopper extension 28 and sealing the upper region of the pre-compress chamber 30. Waste 60 is then loaded into the hopper extension 28. Repetition of the previously described steps is carried out to form yet another new bale and to eject the bale 64 just completed from the secondary bale chamber 40.

Various modifications can be made to the on without departing from the apparent scope hereof.

PARTS LIST

| | |
|---|---|
| 10 | multi-ram bale and tie baler system |
| 12 | framework |
| 14 | hydraulic power unit |
| 15 | control panel |
| 16 | gatherer ram hydraulic actuator cylinder |
| 17 | hydraulic power unit cooling fans |
| 18 | gatherer ram |
| 20 | gatherer ram front plate |
| 22 | gatherer ram top plate |
| 24 | gatherer ram component housing |
| 26 | hopper |
| 28 | hopper extension |
| 30 | pre-compress chamber |
| 32 | pre-compress lid |
| 32a | planar lid plate |
| 32b | arced lid plate |
| 34a–b | pre-compress lid hydraulic actuator cylinder support structure |
| 38 | primary bale chamber |
| 39 | pre-compress lid hydraulic actuator cylinder |
| 40 | secondary bale chamber |
| 42 | ejector ram hydraulic actuator cylinder |
| 44 | ejector ram |
| 46 | ejector ram front plate |
| 48 | ejector ram side plate |
| 50 | bale exit chamber |
| 52 | strapper |
| 54 | strapper power unit |
| 55 | bale strap supply |
| 56 | bale door |
| 58 | protective enclosure |
| 60 | waste |
| 62 | pre-compressed waste |
| 64 | newly formed bale |
| 64a | first unit of compressed waste |
| 64b | second unit of compressed waste |
| 64n | last unit of compressed waste |
| 66 | previously formed bale |
| 68 | strap |

What is claimed is:

1. A multi-ram bale and tie baler system comprising:

a. a framework;

b. a plurality of components mounted to or within the framework including, in order, a hydraulically powered gatherer ram, the hydraulically powered gatherer ram moving along a horizontal path above the framework, a pre-compress chamber, the pre-compress chamber situated along the horizontal path of the hydraulically powered gatherer ram, a powered rotatable pre-compress lid aligned for positioning above the pre-compress chamber, a hopper aligned to and over the pre-compress chamber, a hopper extension aligned to the top of the hopper, wherein waste material in the hopper extension falls from the hopper extension into the hopper and is rotatable urged from the hopper into the pre-compress chamber by the powered rotatable pre-compress lid, a primary bale chamber aligned to and adjacent to one side of the pre-compress chamber, the primary hale chamber also situated along the horizontal path of the hydraulically powered gatherer ram, a secondary bale chamber aligned to the primary bale chamber, the secondary bale chamber also situated along the horizontal path of the hydraulically powered gatherer ram and the secondary bale chamber being capable of communication with the primary bale chamber, an ejector ram, the ejector ram having an ejector ram front plate and an ejector ram side plate, the ejector ram front plate moveable along a horizontal path perpendicular to the horizontal path of the hydraulically powered gatherer ram and passing through the secondary bale chamber and the ejector ram side plate movable between a position forming a sturdy end of the primary bale chamber along the horizontal path of the hydraulically powered gatherer ram and a retracted position off the horizontal path of the hydraulically powered gatherer ram, a bale exit chamber adjacent to and connected to the secondary bale chamber, the bale exit chamber situated off the horizontal path of the hydraulically powered gatherer ram, a bale door, the bale door controlling communication between the secondary bale chamber and the bale exit chamber, a strapper for tieing a bale with strapping located at one end of the bale exit chamber, a strapper power unit; and, c. a hydraulic power unit means connected to said hydraulic powered ram and to said ejector ram.

2. A baling process comprising the steps of:

a. providing a baler, the baler including a hydraulically powered gatherer ram movable along a horizontal path, a pre-compress chamber on the horizontal path, a primary bale chamber on the horizontal path adjacent to the pre-compress chamber, a secondary bale chamber on the path and adjacent to the primary bale chamber, a bale exit chamber off the horizontal path and adjacent to the secondary bale chamber, an ejector ram having a ejector ram end plate and an ejector ram side plate, the ejector ram end plate movable through the secondary bale chamber along a path perpendicular to the horizontal path of the gatherer ram and the ejector ram side plate movable between a position forming a sturdy end to the primary bale chamber and a position off the horizontal path of the hydraulically powered gatherer ram, and further including a hopper and a hopper extension above the pre-compress chamber, and a pre-compress lid rotatable through the hopper to the pre-compress chamber and a bale strap chamber in communication with the bale exit chamber, the bale strap chamber having a strapping machine;

b. at the same time, compressing waste material in the pre-compress chamber and the primary bale chamber and the secondary bale chamber;

c. simultaneous handling and processing of a previously formed and completed bale is effected by continual incremental urging of the previously formed and completed bale from the secondary bale chamber to a bale exit chamber;

d. wherein such urging of the previously formed and completed bale from the secondary bale chamber to the bale exit chamber positions the previously formed and completed bale along the bale strap chamber to align various portions of the bale with the strapping machine to receive a plurality of straps applied around and about the previously formed and completed bale; and, e. tieing the plurality of straps around and about the previously formed and completed bale, whereby continual simultaneous compressing and strapping occur to provide for maximum efficiency and minimum throughput time.

3. The baling process of claim 2, wherein the pre-compress lid is a powered pre-compress lid.

4. The baling process of claim 2, wherein waste material to be baled passes, in progressing order, through the hopper extension, then through the hopper, then through the pre-compress chamber, then through the primary bale chamber, then through the secondary bale chamber therein becoming formed and completed as bale, which in turn passes through the bale exit chamber to a bale strapping chamber to be tied with the plurality of straps.

5. The baling process of claim 2, wherein a subsequent bale is being preliminarily formed in the primary chamber while the previously formed and completed bale is being strapped and tied.

6. The baling process of claim 2, wherein the pre-compress lid rotates between a position forming a seal of an upper region of the pre-compress chamber and a position perpendicular to the upper region of the pre-compress chamber.

7. The baling process of claim 6, wherein the pre-compress lid, while forming a seal of the upper region of the pre-compress chamber simultaneously closes the hopper extension.

8. The baling process of claim 6, wherein rotation of the pre-compress lid from the position perpendicular to the upper region of the pre-compress chamber to the position sealing the upper region of the pre-compress chamber serves to pre-compress waste in the pre-compression chamber.

9. The baling process of claim 8, wherein the ejector ram simultaneously advances to urge a previously formed and completed bale to a position appropriate to receiving a second strap of the plurality of straps.

10. The baling process of claim 7, wherein the gatherer ram only advances when the pre-compress lid has sealed the upper region of the pre-compress chamber and thereby prevents un-timely dropping of waste material from the hopper.

11. The baling process of claim 2, wherein the gatherer ram partially forms a bale of compressed waste material in the primary bale chamber against the side plate of the ejector ram.

12. The baling process of claim 11, wherein pre-compress lid is positioned to have sealed the upper region of the pre-compression chamber while the gatherer ram is partially forming a bale in the primary bale chamber.

13. The baling process of claim 10, wherein the pre-compress lid is only opened to allow waste material to enter the pre-compress chamber when the gatherer ram is fully retracted from the secondary bale chamber, the primary bale chamber and the pre-compress chamber.

14. A waste material baler comprising:

a. a frame work;

b. a gatherer ram mounted to the framework, the gatherer ram movable along a horizontal path above the framework;

c. a pre-compress chamber, a primary bale chamber, and a secondary bale chamber, in order, on the horizontal path of the gatherer ram;

d. an ejector ram, the ejector ram having an end plate and a side plate, the ejector ram movable along a horizontal path perpendicular to the path of the gatherer ram, the ejector ram passing through the secondary bale chamber to expel compressed or baled waste material therefrom and wherein the side plate of the ejector ram forms a sturdy end to the primary bale chamber, the sturdy end being situated on the horizontal path of the gatherer ram; and, e. a bale exit chamber, the bale exit chamber being on the horizontal path of the ejector ram so as to receive expelled compressed or baled material from the secondary bale chamber.

15. The waste material baler of claim 14, further comprising a hopper above the pre-compress chamber.

16. The waste material baler of claim 15, further comprising a pre-compress lid rotatable within the hopper from a position sealing an upper region of the pre-compress chamber to a position opening the upper region of the pre-compression chamber to receive waste material from the hopper.

17. The waste material baler of claim 16, further comprising means to rotationally pre-compress waste material from the hopper into the pre-compress chamber.

18. The waste material baler of claim 17, further comprising a hopper extension above the hopper.

19. The waste material baler of claim 14, further comprising a strapper for tying a strap about expelled compressed or baled waste material passing through the bale exit chamber.

20. The waste material baler of claim 19, wherein the strap to be tied is one of a plurality of straps to be tied.

21. The waste material baler of claim 20, wherein the plurality of straps to be tied are sequentially tied upon the expelled compressed or baled waste material as the expelled compressed or baled waste material is progressively passing through the bale exit chamber.

22. The waste material baler of claim 14, wherein compression may be generated within the primary bale chamber by the gatherer ram moving toward the side plate of the ejector ram.

23. The waste material baler of claim 14, wherein compression may be generated within the secondary bale chamber by the gatherer ram moving toward the secondary bale chamber when the ejector ram is retracted and the side plate is not in the horizontal path of the gatherer ram.

24. The waste material baler of claim 22, wherein compression may be generated within the primary bale chamber by the gatherer ram moving against the side plate of the ejector ram while the ejector ram is extended toward the bale exit chamber.

25. The waste material baler of claim 24, wherein compression may be generated within the primary bale chamber by the gatherer ram moving against the side plate of the ejector ram while simultaneously a strap is being tied or a bale is being advanced for tying a strap by extension of the ejector ram past the secondary bale chamber.

26. The waste material baler of claim 16, wherein the gatherer ram is only retracted when the pre-compress lid is sealing upper regions of the pre-compress chamber.

* * * * *